US005776265A

United States Patent [19]

Kramer et al.

[11] Patent Number: 5,776,265

[45] Date of Patent: Jul. 7, 1998

[54] PROCESS FOR ACTIVATING A METAL SURFACE FOR CONVERSION COATING

[75] Inventors: Linda S. Kramer, Troy; Robin M. Dunn, Royal Oak; Terrence R. Giles, Brighton; Robert W. Miller, Clarkston, all of Mich.

[73] Assignee: Henkel Corporation, Plymouth Meeting, Pa.

[21] Appl. No.: 624,623

[22] PCT Filed: Oct. 26, 1993

[86] PCT No.: PCT/US93/10243

§ 371 Date: Apr. 26, 1996

§ 102(e) Date: Apr. 26, 1996

[87] PCT Pub. No.: WO95/12011

PCT Pub. Date: May 4, 1995

[51] Int. Cl.[6] ..... C23C 22/80

[52] U.S. Cl. ..... 148/241; 148/254

[58] Field of Search ..... 148/241, 254

[56] References Cited

U.S. PATENT DOCUMENTS

| | | | |
|---|---|---|---|
| 2,459,847 | 12/1949 | Jernstedt | 148/254 |
| 4,529,451 | 7/1985 | Otrhalek | 148/241 |
| 4,531,978 | 7/1985 | Otrhalek | 148/241 |

FOREIGN PATENT DOCUMENTS

| | | | |
|---|---|---|---|
| 61-170576 | 8/1986 | Japan | 148/241 |

*Primary Examiner*—Sam Silverberg

*Attorney, Agent, or Firm*—Ernest G. Szoke; Wayne C. Jaeschke; Daniel S. Ortiz

[57] ABSTRACT

The invention is a process for applying a phosphate coating to a metal substrate in which the metal substrate is contacted with an aqueous activating bath before the phosphate coating is applied. The improved process is obtained by applying ultrasonic vibration energy to the aqueous activating bath. The ultrasonic energy can be applied to the aqueous activating bath when the aqueous activating bath is in contact with the metal substrate or when the metal substrate is not in contact with the aqueous activating bath.

12 Claims, 19 Drawing Sheets

1 2 5 6 Day 1 2 5 6 Day 1 2 5 6 Day 1 2 5 6 Day 1 2 5 6 Day 1 2 5 6 Day

1

2

5

6 Day

CRS
Sonicated

EG
Stirred

EG
Sonicated

6061
Stirred

6061
Sonicated

CRS
Sonicated

EG
Stirred

EG
Sonicated

6061
Stirred

6061
Sonicated

CRS
Stirred

CRS
Sonicated

EG
Sonicated

6061
Sonicated

CRS
Stirred

CRS
Sonicated

EG
Sonicated

6061
Sonicated

CRS
Stirred

CRS
Sonicated

EG
Sonicated

6061
Sonicated

CRS
Stirred

CRS
Sonicated

EG
Sonicated

6061
Sonicated

CRS
Stirred

EG
Stirred

6061
Stirred

CRS
Stirred

EG
Stirred

6061
Stirred

CRS

EG

6061

CRS

EG

6061

CRS

EG

6061

CRS

EG

6061

CRS

EG

6061

CRS

EG

6061

CRS

EG

6061

CRS

EG

6061

CRS

EG

6061

CRS

EG

6061

PROCESS FOR ACTIVATING A METAL SURFACE FOR CONVERSION COATING

FIELD OF THE INVENTION

The invention is an improved method for providing a phosphate conversion coating on a metal substrate.

BACKGROUND OF THE INVENTION

A variety of compositions and processes have been used to provide an adherent, uniform phosphate coating on a metal surface. The phosphate coating is applied to enhance the adhesion of subsequently applied coatings and to provide for improved corrosion resistance of the coated metal substrate.

Phosphate coating processes (known as phosphating or phosphate conversion coating processes) are well known in the art. Generally, the phosphating process comprises contacting the metal surface with a acidic phosphate solution. The phosphating solution generally contains ions of metals such as zinc, nickel, manganese, copper, chromium and other metals which are known to provide conversion coatings on metal substrates in an acidic phosphate solution.

The metal substrate can be contacted with the acidic phosphate solution by immersion, spraying, roller coating, flowing and other means known for contacting a metal with an aqueous solution. Acidic phosphate conversion coating solutions are well known in the art and have been found very useful for providing a base for application of a protective coating to the metal substrate.

As disclosed in U.S. Pat. No. 2,310,239 to Jernstedt, U.S. Pat. No. 2,874,812 to Cavanagh and Maurer and in U.S. Pat. No. 4,539,051, to Hacias, conversion coatings can be improved if, prior to contacting the metal to be phosphate coated with the acidic phosphate solution, the metal surface is first activated by contact with an aqueous activating composition. The aqueous activating compositions are generally mixtures comprising water with a reaction product of a titanium compound and a phosphate. The aqueous activating compositions are at an alkaline pH, generally in the range of about 7 to about 11 and preferably in the range of from about 8 to about 10. Titanium compound-phosphate compound reaction products generally contain from about 0.005 to about 25% by weight titanium. As is disclosed in the cited references, a cleaned metal substrate is contacted with an aqueous activating composition to assist in providing an even coating with low coating weight and small crystal morphology in the phosphate conversion coating step.

It is well known in the art that after the aqueous activating composition is prepared by mixing a dry activating composition with water, the aqueous activating composition loses its activating ability as time passes and the aqueous composition ages. The activating ability of the aqueous activating composition declines with time even if the composition has not been exhausted by contact with metal substrates. It would be useful to be able to extend the useful life of the aqueous activating compositions. The time period since preparation of the aqueous activating composition is known as the aging period or aging.

Contacting the metal substrate with the aqueous activating composition provides for a phosphate conversion coating which has a small crystal size, optimal coating weight and a more even coating than substrates which have been contacted with acidic phosphate solutions without prior contact with the aqueous activating composition.

Before the metal substrate is contacted with the aqueous activating composition and conversion coated, it is important that the metal substrate be clean. Cleaning of the metal substrate is generally accomplished by contacting the metal substrate with an acidic or an alkaline cleaning composition. Generally, the alkaline compositions are preferred since the activating composition is at an alkaline pH. However, as long as the metal substrate is rinsed of the cleaning solution, an acidic cleaning solution can be utilized.

A BRIEF SUMMARY OF THE INVENTION

According to the present invention, an improved phosphate conversion coating can be formed on a metal substrate by the process by contacting an aqueous activating composition used to activate the metal substrate with ultrasonic vibration energy. Ultrasonic vibrations (ultrasonic energy) can be applied to the aqueous activating composition (hereinafter activating bath), in the presence or in the absence of the metal substrate which is to be activated. The largest increase in the quality of the phosphate coating in the process is obtained if the ultrasonic vibrations are applied to the activating bath in the presence of the metal substrate.

The process of the invention comprises cleaning the is metal substrate, contacting the metal substrate with an activating bath which has been subjected to application of ultrasonic energy to provide an activated metal substrate and phosphating the activated metal substrate.

DESCRIPTION OF THE PREFERRED EMBODIMENTS OF THE INVENTION

Figure 1A:
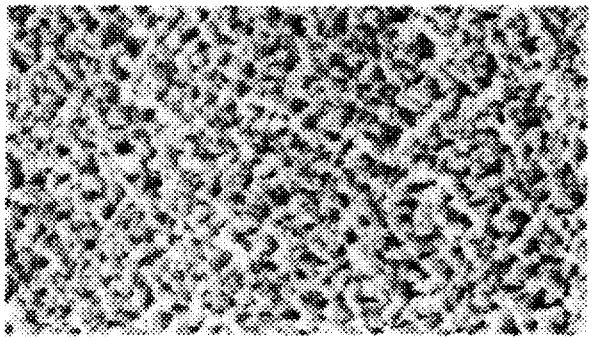
FIG. 1 (*a*) (*b*) and (*c*) are scanning electron photomicrographs at 1,000 magnification of phosphated cold rolled steel panels prepared by the process using Bath 1 before and after aging for 12 days.
Figure 1B:
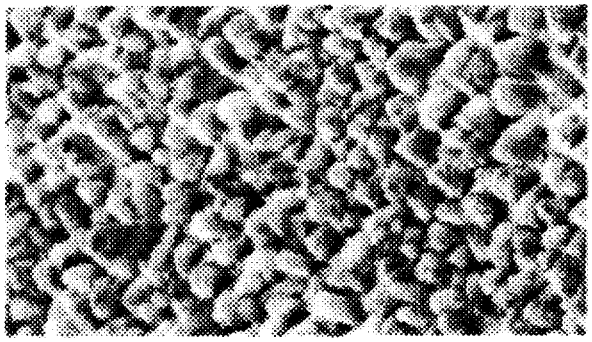
Figure 1C:
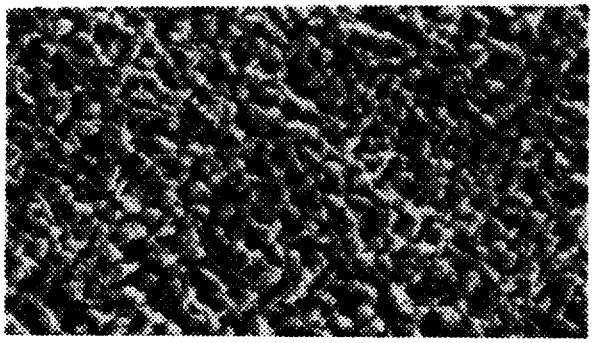
Figure 2A:
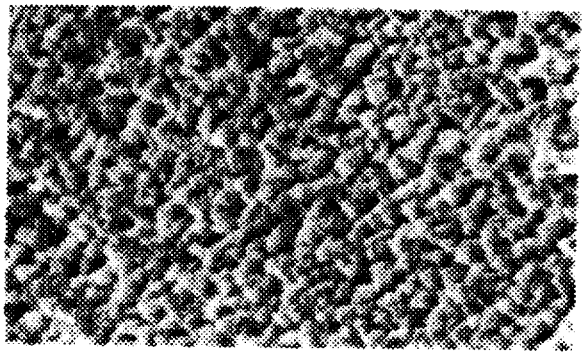
FIG. 2 (*a*), (*b*) and (*c*) are scanning electron photomicrographs at 1,000 magnification of phosphated cold rolled steel panels prepared by the process using Bath 2 before and after aging for 12 days.
Figure 2B:
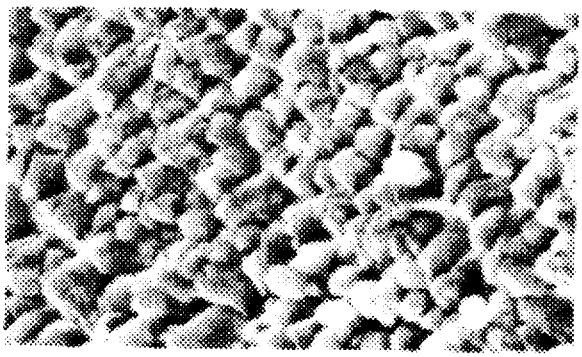
Figure 2C:
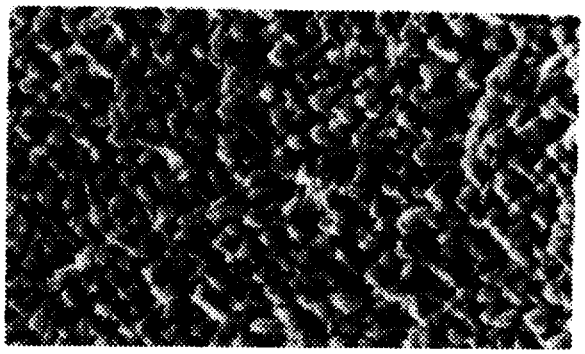
Figure 3A:
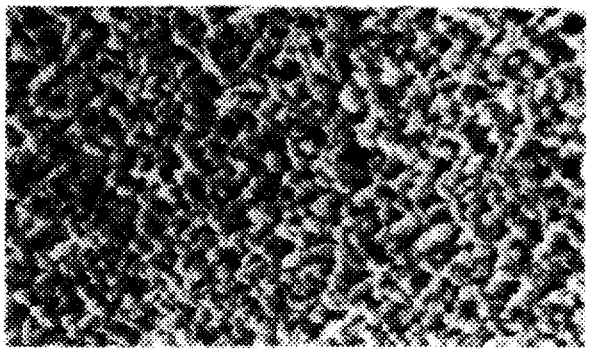
FIG. 3 (*a*), (*b*) and (*c*) are scanning electron photomicrographs at 1,000 magnification of phosphated cold rolled steel panels prepared by the process using Bath 3 before and after aging for 12 days.
Figure 3B:
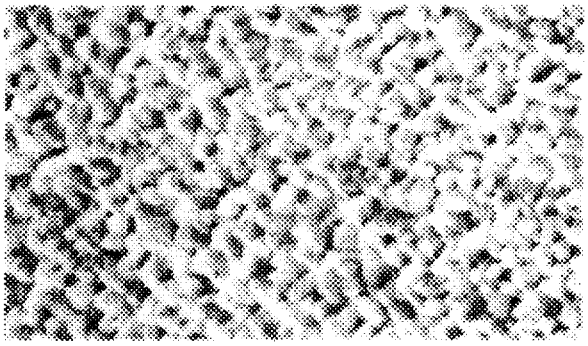
Figure 3C:
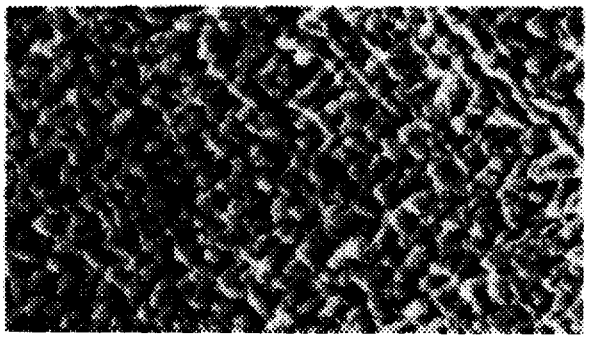
Figure 4A:
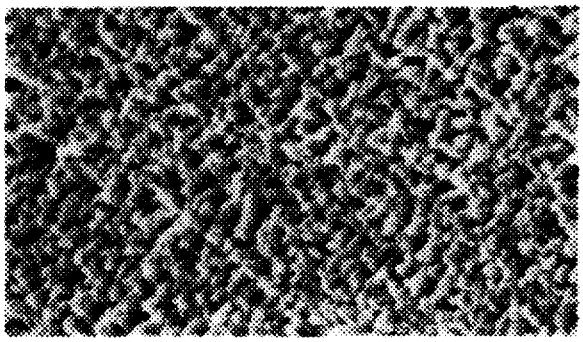
FIG. 4 (*a*), (*b*) and (*c*) are scanning electron photomicrographs at 1,000 magnification of phosphated cold rolled steel panels prepared by the process using Bath 4 before and after aging for 12 days.
Figure 4B:
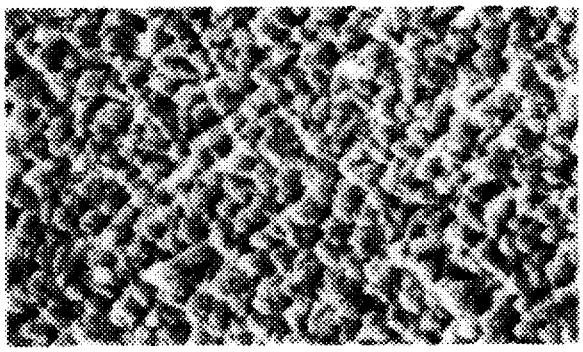
Figure 4C:
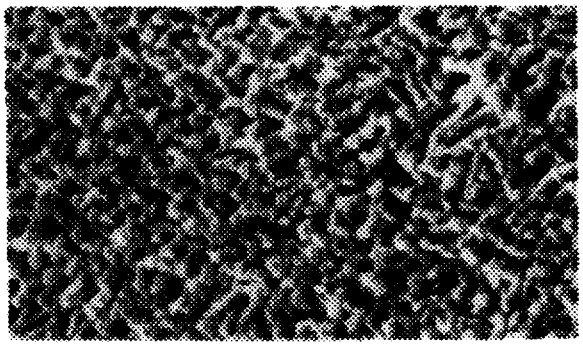
Figure 5A:
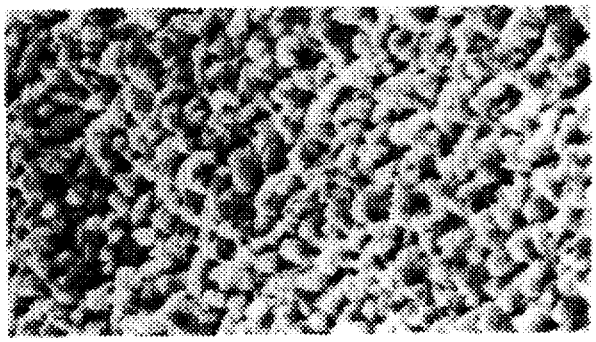
FIG. 5 (*a*) and (*b*) are scanning electron photomicrographs at 1,000 magnification of phosphated cold rolled steel panels prepared by the process using Bath 5 before and after aging for 12 days.
Figure 5B:
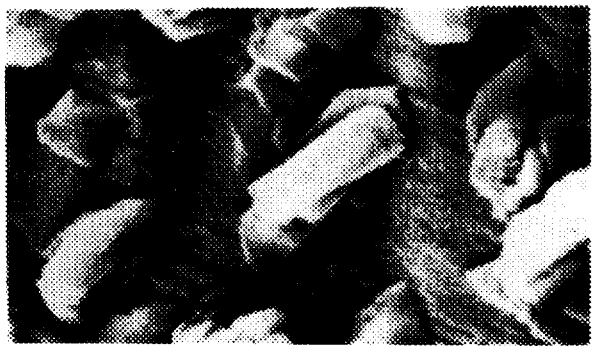
Figure 6A:
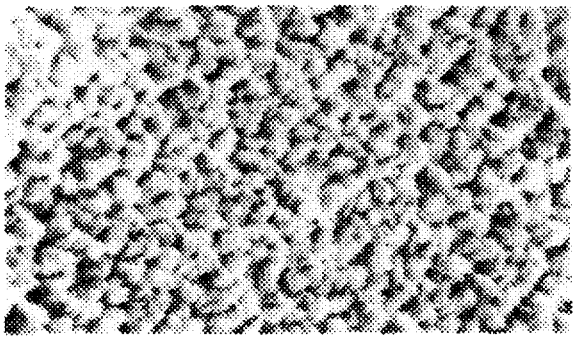
FIG. 6 (*a*), (*b*) and (*c*) are scanning electron photomicrographs of 1,000 magnification of phosphated cold rolled steel panels prepared by the process using a fresh control bath each day without ultrasonic energy applied.
Figure 6B:
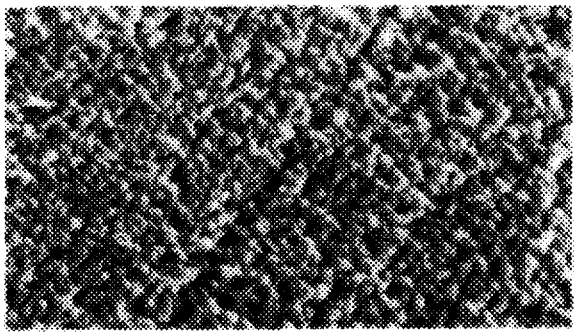
Figure 6C:
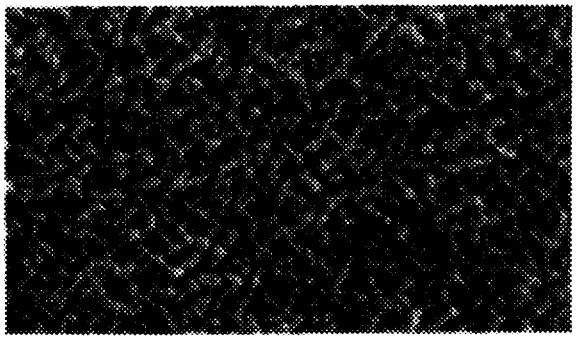
Figure 7A:
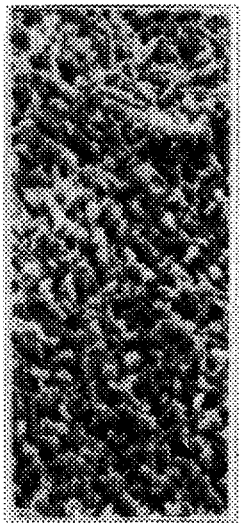
FIG. 7 (*a*), (*b*), (*c*), and (*d*) are scanning electron photomicrographs at 1,000 magnification of phosphated cold rolled steel panels prepared by the process using Bath 6, after aging for 1, 2, 5 and 6 days.
Figure 7B:
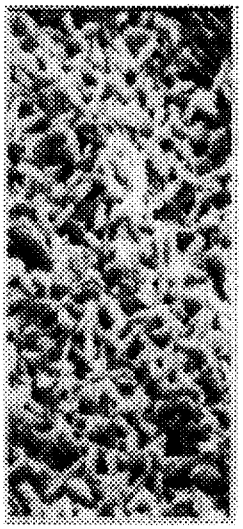
Figure 7C:
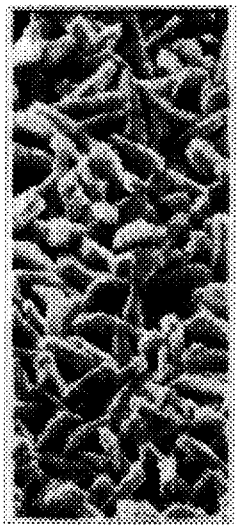
Figure 7D:
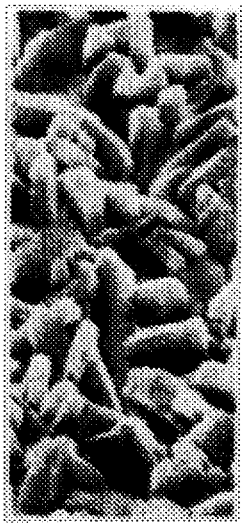
Figure 8A:
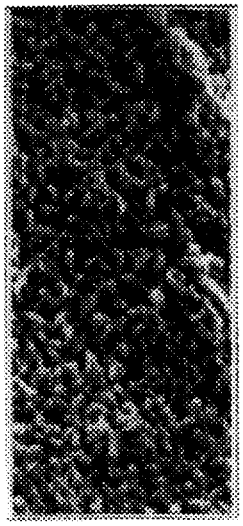
FIG. 8 (*a*), (*b*), (*c*), and (*d*) are scanning electron photomicrographs at 1,000 magnification of phosphated cold rolled steel panels prepared by the process using Bath 7, after aging for 1, 2, 5 and 6 days.
Figure 8B:
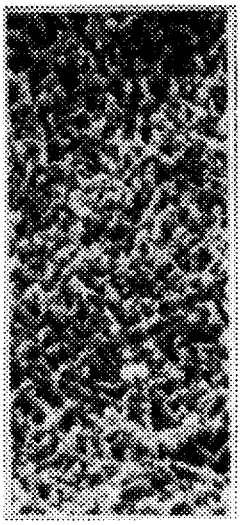
Figure 8C:
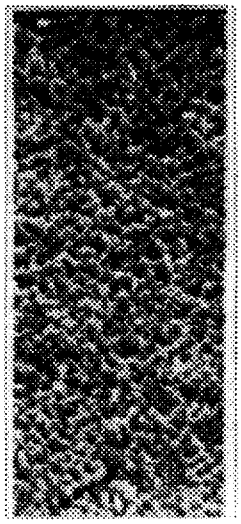
Figure 8D:
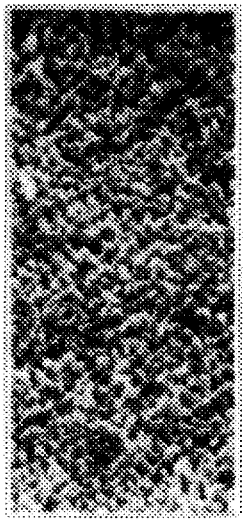
Figure 9A:
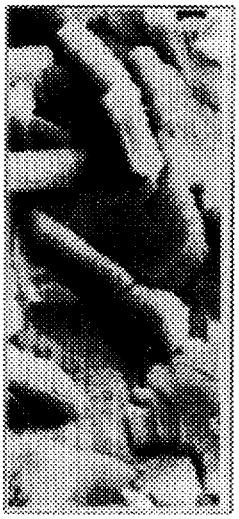
FIG. 9 (*a*), (*b*), (*c*), and (*d*) are scanning electron photomicrographs at 1,000 magnification of phosphated cold rolled steel panels prepared by the process using Bath 8, after aging for 1, 2, 5 and 6 days.
Figure 9B:
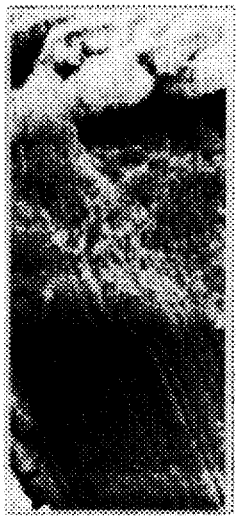
Figure 9C:
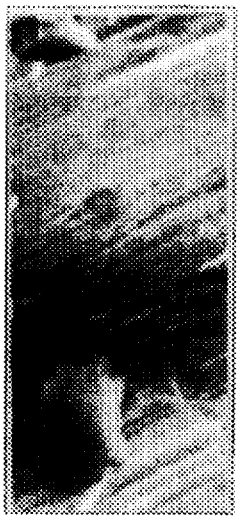
Figure 9D:
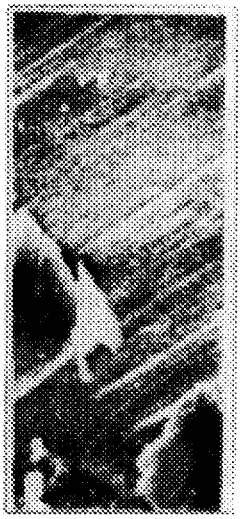
Figure 10A:
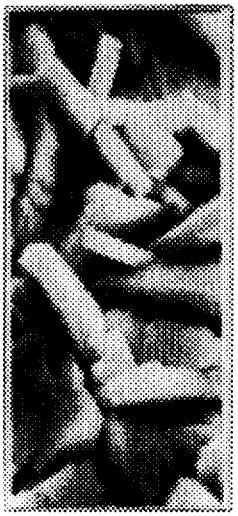
FIG. 10 (*a*), (*b*), (*c*), and (*d*) are scanning electron photomicrographs at 1,000 magnification of phosphated cold rolled steel panels prepared by the process using Bath 9, after aging for 1, 2, 5 and 6 days.
Figure 10B:
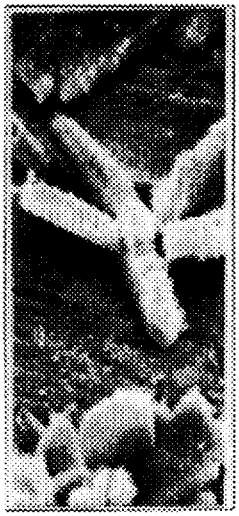
Figure 10C:
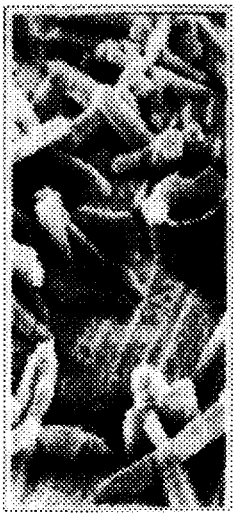
Figure 10D:
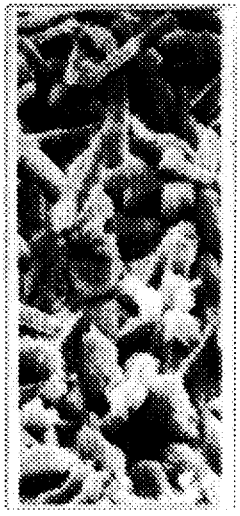
Figure 11A:
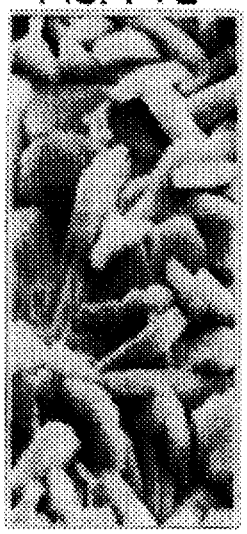
FIG. 11 (*a*), (*b*), (*c*), and (*d*) are scanning electron photomicrographs at 1,000 magnification of phosphated cold rolled steel panels prepared by the process using Bath 10, after aging for 1, 2,.5 and 6 days.
Figure 11B:
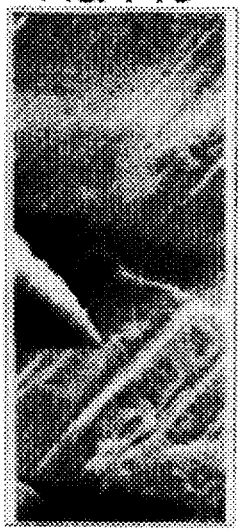
Figure 11C:
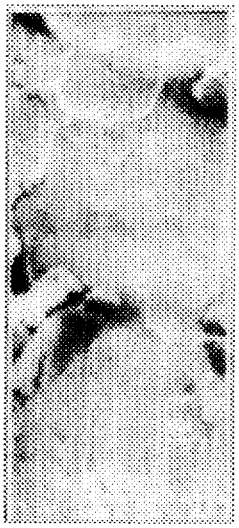
Figure 11D:
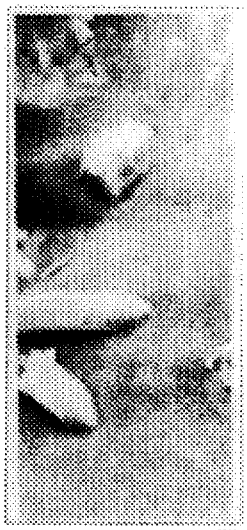
Figure 12A:
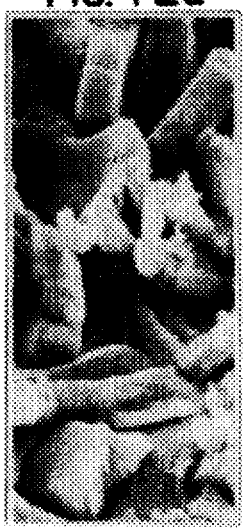
FIG. 12 (*a*), (*b*), (*c*), and (*d*) are scanning electron photomicrographs at 1,000 magnification of phosphated cold rolled steel panels prepared by the process using Bath 11 after aging for 1, 2, 5 and 6 days.
Figure 12B:
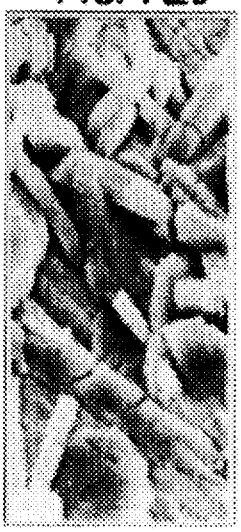
Figure 12C:
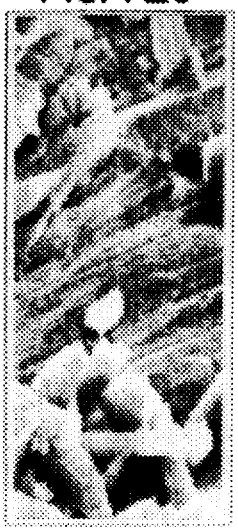
Figure 12D:
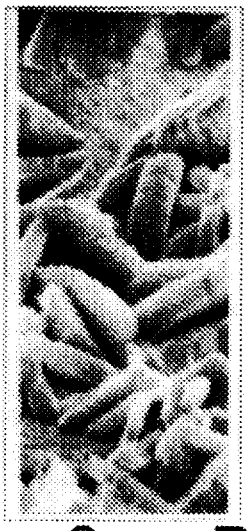
Figure 13A:
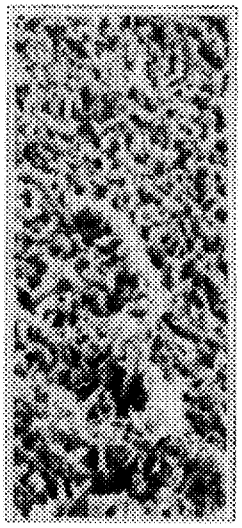
FIG. 13 (*a*), (*b*), (*c*) and (*d*) are scanning electron photomicrographs at 1,000 magnification of cold rolled steel panels phosphated on days 1, 2, 5 and 6 by the process using a freshly prepared FIXODINE® brand activating control bath each day without ultrasonic energy applied.
Figure 13B:
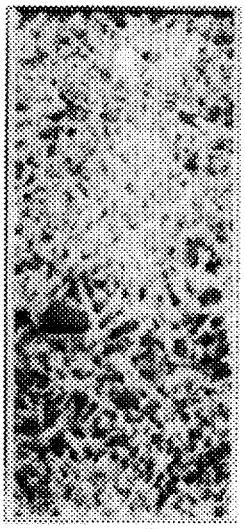
Figure 13C:
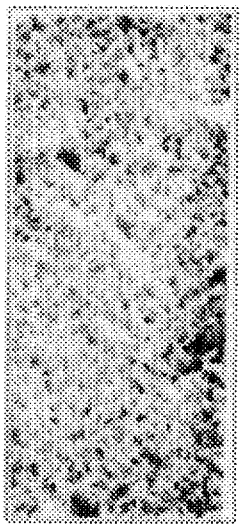
Figure 13D:
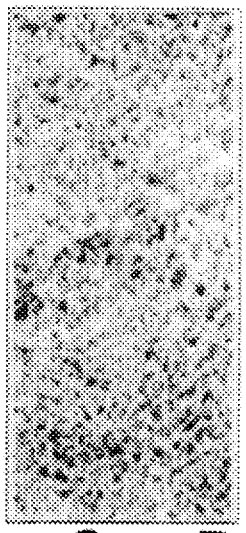

Metal substrates which can be advantageously treated by the process of the present invention include iron, zinc, zinc alloys, aluminum and aluminum alloys containing at least about 60%–70% aluminum. The substrate to be treated by the process of the present invention need not be made of the metal alone. That is, zinc plated and aluminum composite materials may be advantageously treated by the process of the invention.

As is well known in the art for providing phosphate coatings on metal substrates, the metal must be clean to permit an adherent phosphate coating to be formed. The metal substrates are generally cleaned by contact with an alkaline or an acid cleaning solution to remove any grease, dirt, scale, oxidized coating and the like from the surface of the metal substrate. Acid cleaners generally contain sulfuric and/or phosphoric acid. In addition, if the metal substrate is aluminum, a small amount of fluoride ion is generally included in the cleaning composition.

Alkaline cleaners can be utilized to prepare the metal substrate for accepting the phosphate coating. Alkaline cleaners are generally composed of alkali materials such as caustic, soda ash, trisodium phosphate, sodium polyphosphate, sodium silicate, and surfactants. The metal substrate to be cleaned is contacted with a dilute solution of the alkaline cleaner. The metal to be cleaned is generally contacted with the aqueous cleaning solution at a temperature in the range of from about ambient to about 160° F. and preferably from about 100° F. to about 150° F. Metal can be cleaned by contacting the metal with the aqueous cleaning composition by immersion, spraying, flowing, and other means for contacting a metal with an aqueous cleaning solution. Generally, the metal substrate is immersed in the aqueous solution or the aqueous cleaning solution is sprayed onto the metal substrate. The metal is contacted with the cleaning solution for from about 30 seconds to about 10 minutes and preferably from about 1 to about 3 minutes.

After the metal substrate has been cleaned with the cleaning solution, the cleaning solution is rinsed from the surface of the metal substrate with water.

After the metal substrate has been cleaned and rinsed with water, the metal substrate is generally contacted with a mixture of water and an activating composition. A preferred activating composition is a reaction product of a titanium compound with a phosphate compound. The activating compositions are mixed with the water to form an aqueous activating composition (activating bath) and contacted with the metal substrates. Preferably, the aqueous activating composition contains from about 0.05 to about 25 grams per liter of the activating composition. The activating composition is generally not soluble in water and a dispersion of the activating composition in an aqueous phase (activating bath) is generally obtained.

The activating composition is a reaction product of a titanium containing composition with a phosphate. This reaction product can be combined with an additional phosphate material such as sodium tripolyphosphate, sodium pyrophosphate, disodium phosphate and the like. The activating composition is a dry material containing at least 0.005% titanium and is mixed with water to form the aqueous activating composition. The activating composition may contain an alkaline material such as sodium carbonate or caustic to help provide an aqueous activating composition with an alkaline pH. The pH is generally between about 7 and 11 and preferably between about 8 and 10.

In known processes, the cleaned metal substrate is then contacted with the activating bath for from about 5 seconds to about 10 minutes, preferably from about 20 seconds to about 5 minutes. The activating bath is contacted with the metal substrate at a temperature of from about ambient to about 150° F., preferably from about 75° to about 110° F.

Applicants have discovered that if ultrasonic vibrations (ultrasonic energy) are applied to the activating bath, a phosphate conversion coating, which is later formed on the substrate, has a smaller crystal size, an optimum coating weight and is more uniform. That is, the surface of the metal substrate is more uniformly coated with a phosphate coating. The ultrasonic power can be applied to the aqueous activating composition alone or it can be applied to the aqueous activating composition when in contact with a metal surface which is to be activated. The most dramatic results are provided when the ultrasonic power is applied to the aqueous activating composition when in contact with the metal substrate to be activated. Ultrasonic power can be applied to the aqueous activating composition in the metal contacting zone in the presence or absence of a metal substrate or can be applied to the aqueous activating composition in a separate ultrasonic treating zone outside of the contacting zone. The ultrasonic power can be applied to the aqueous activating composition continuously, only when the aqueous activating composition is being used to activate a metal substrate, only when the aqueous activating composition is not being used to contact metal substrate, in a predetermined discontinuous manner or in a discontinuous random manner. In a preferred embodiment, the metal substrate is contacted with the aqueous activating composition at the same time as ultrasonic power is applied to the composition.

The metal substrate can be contacted with the aqueous activating composition by immersion, spraying, flowing or any other method used for contacting a metal substrate with an aqueous composition.

Applicants have discovered that the aqueous activating composition has a lesser improvement on the final phosphate coating when the ultrasonic power is applied to the aqueous activating composition in the absence of the metal substrate or applied to the aqueous activating composition externally to the contact zone. Excellent phosphate coatings are formed on the metal substrate when the ultrasonic power is applied to the aqueous activating composition in a contacting zone during contact with the metal substrate to be activated.

After the metal substrate has been removed from contact with the activating bath, the metal substrate is then passed to a phosphate conversion coating zone. In the phosphate conversion coating zone, the activated metal substrate is contacted with an acidic phosphate containing conversion coating solution to provide an adherent metal phosphate coating on the metal substrate.

Phosphate conversion coating compositions are well known to one skilled in the art. Phosphate conversion coating compositions have been used for more than 40 years. The acidic phosphate compositions are well known; however, new additives to increase the rate at which the coating is formed, alter the size and shape of the crystals of the coating and the like can be included in the composition to provide a more useful coating.

As is well known in the art, the goal of a phosphate conversion coating process is to provide an adherent coating with a crystal structure optimized for the intended use, with maximum coverage for the weight of phosphate coating. Clearly, when the phosphate coating is to be coated with an additional organic coating material, to form a corrosion resistant coating, the phosphate coating is desirably as even as possible and of the lowest weight per unit area. Uniform coatings of small crystal size and excellent coverage can be provided by the process of the present invention.

In the phosphating process, contact with the activating bath is required to provide a uniform coating having crystals with a small size. After the substrate has received the phosphate coating, the substrate is then rinsed to remove the acid phosphate solution.

The phosphate coating can be further improved by contacting the phosphate coated metal with a sealing and adhesion promoting composition. Generally, the sealing and adhesion promoting composition is an acidic chromate containing solution. However, other post treatment solutions can be utilized. The phosphated metal can be coated by additional coating materials known in the art.

A series of experiments were conducted to determine the effect of ultrasonic vibrations on the properties of phosphate coatings prepared by contacting a cleaned metal substrate, to be phosphate coated, with a titanium compound-phosphate reaction product activating composition in an aqueous dispersion.

EXPERIMENT 1

Metal test panels were processed using a standard phosphating process cycle. In the tests, the metal test panels were treated according to the following process. The metal test panels were cleaned by contact with PARCO® CLEANER 1500C at 2 ounces per gallon at 110° F. by spraying for 2 minutes; rinsing with warm water with a 45 second spray; contact with an aqueous activating composition of water and FIXODINE® ZN at 80° F. by immersion for 30 seconds; contact with a BONDERITE® 3080 phosphating solution according to manufacturers' recommendations, by immersion in the aqueous phosphating solution at 112° F. for 2 minutes. After immersion in the phosphate coating composition, the panels were rinsed with cold water for 30 seconds and oven dried.

PARCO® CLEANER 1500C is an alkali cleaner (product of Parker+Amchem). FIXODINE® ZN activating composition is a composition containing a reaction product of a titanium containing compound with phosphates, subsequently mixed with sodium phosphates and sodium carbonate (product of Parker+Amchem). BONDERITE® 3080 phosphating composition is an aqueous acidic zinc-manganese-nickel-phosphate conversion coating composition (product of Parker+Amchem).

The effect of ultrasonic power applied to the aqueous activating composition on the phosphate coatings formed by the process were determined by the following experimental design.

| | Bath 1 | Bath 2 | Bath 3 | Bath 4 | Bath 5 |
|---|---|---|---|---|---|
| Day 1 | *X | US*X | US*X | US*X | *X |
| Day 2 | — | — | — | US* | — |
| Day 3 | * | * | * | US* | * |
| Day 4 | — | — | — | US* | — |
| Day 5 | * | * | US* | US* | * |
| Day 8 | * | * | * | US* | * |
| Day 9 | — | — | — | US* | — |
| Day 10 | * | * | US* | US* | * |
| Day 11 | — | — | — | US* | — |
| Day 12 | *X | *X | *X | *X | *X |
| Day 12 | US*X | US*X | US*X | US*X | — |

* Bath conditions and particle size were checked.
US Ultrasonic vibration applied to activating bath.
X Test panel contacted with the aqueous activating bath.
— No tests or treatments to the activating bath.

A standard water solution was prepared by diluting
79 ml $CaCl_2$ solution (10 g/l)
53 ml $MgSO_4$ solution (10 g/l)
26 ml $NaHCO_3$ solution (10 g/l)
to 9 liters with deionized water. This solution is noted as standard water and was utilized to prepare the FIXODINE® ZN brand activating baths. The standard water was analyzed and found to contain: 21 ppm Ca, 10 ppm Mg, 7 ppm Na and hardness (as $CaCO_3$) of 120 ppm.

Activating Baths 1–4 were prepared by mixing 1.5 grams of FIXODINE® ZN brand activating composition and 0.22 grams of soda ash (for adjustment of pH 9.0±0.3) per liter of standard water.

Bath 5 was prepared by mixing 1.5 grams of FIXODINE® ZN brand activating composition and 0.22 grams of soda ash (pH adjustment to 9.0±0.3) per liter of deionized water.

No ultrasonic vibrations were applied to activating Baths 1 and 5. Ultrasonic vibrations at a frequency of 40 kilohertz were applied to activating Baths 2, 3 and 4 for 2 minutes. In addition the baths were treated with ultrasonic vibration as shown in the experimental design.

All the baths were analyzed for total titanium, filterable titanium, pH and total alkalinity.

Total titanium is the total amount of titanium in the activating bath in parts per million.

Filterable titanium is the amount of titanium, in parts per million, in the activating bath which passes through a filter medium with 2.5 micron openings.

Total alkalinity is determined as the number of ml of 0.1N $H_2SO_4$ required to titrate a 10 ml sample to a bromphenol blue end point.

The test panels were prepared after ultrasonic vibrations had been applied to the activating baths in accordance with the experimental design. The ultrasonic vibrations were applied to the activating baths in the ultrasonic power zone of a BRANSONIC® Model PC620 at 40 kilohertz in all experiments reported in this application.

Test panels were prepared by the process on day 1 after ultrasonic treatment of the activating bath (if applicable) and on day 12 before and after ultrasonic treatment of the activating bath. The ultrasonic treatment of the activating Baths 1 through 4 was in the treating zones in the absence of the metal substrate. The results of the test are set forth in Tables 1 through 5. Tables 1 through 5 disclose the properties of the bath and in addition provide coating weight, crystal size and crystal number.

The crystal number is the number of crystals in one square inch of the scanning electron photomicrograph at 1,000 magnification of the surface of the coated substrate. The maximum crystal number reported is 100. This includes metal substrates wherein there are more than 100+ crystals per square inch in the scanning electron photomicrograph at 1,000 magnification of the coated metal surface. The preferred coatings have an optimum coating weight, small crystal size and a large crystal number.

The data in Tables 1–5 show that ultrasonic energy treatment of aged activating baths, when not in contact with the metal substrate, provides a lower coating weight with a smaller crystal size and a larger crystal number than aged aqueous activating baths which have not been ultrasonically treated. The best phosphate coatings after 12 days aging of the bath were obtained by using activating baths which had been treated with ultrasonic vibrations every day during the 12 days of aging. The coating weight after 12 days aging was the same as the coating weight of phosphate coating obtained by using the fresh activating bath in the process, with the same crystal size and nearly the same crystal number.

Activating Bath 5 was prepared with deionized water. It is generally known that the activating effect of the activating bath made with deionized water deteriorates during aging. Bath 5 was included in this study to show that the effect of the application of ultrasonic energy to the Baths 1 through 4 was different than the effect seen with deionized water. With the application of ultrasonic energy to the activating bath, excellent coatings were obtained, even after aging of the baths.

TABLE 1

BATH 1

| | Ultrasonics Applied | Total Ti (ppm) | Filterable Ti (ppm) | pH | Total Alkali (points) | Coating Weight (g/sq m) | Crystal Size (microns) | Crystal Number |
|---|---|---|---|---|---|---|---|---|
| Day 1 | no | 16.0 | 3.0 | 9.10 | 3.4 | 2.33 | 1–4 | 100 |
| Day 2 | no | | | | | | | |
| Day 3 | no | 16.0 | 4.5 | 8.91 | 3.5 | | | |
| Day 4 | no | | | | | | | |
| Day 5 | no | 16.0 | 4.0 | 8.86 | 3.4 | | | |
| day 8 | no | 16.0 | 4.0 | 8.80 | 3.3 | | | |
| Day 9 | no | | | | | | | |
| Day 10 | no | 9.0 | 3.0 | 8.73 | 3.5 | | | |
| Day 11 | no | | | | | | | |
| Day 12 | no | 15.5 | 3.0 | 8.74 | 3.3 | 3.27 | 3–8 | 30 |
| Day 12 | yes | 11.0 | 6.0 | 8.78 | 3.4 | 2.36 | 1–5 | 65 |

TABLE 2

BATH 2

| | Ultrasonics Applied | Total Ti (ppm) | Filterable Ti (ppm) | pH | Total Alkali (points) | Coating Weight (g/sq m) | Crystal Size (microns) | Crystal Number |
|---|---|---|---|---|---|---|---|---|
| Day 1 | yes | 16 | 6.0 | 9.15 | 3.4 | 2.12 | 1–3 | 100 |
| Day 2 | no | | | | | | | |
| Day 3 | no | 16 | 4.5 | 9.07 | 3.5 | | | |
| Day 4 | no | | | | | | | |
| Day 5 | no | 16 | 7.0 | 8.98 | 3.4 | | | |
| Day 8 | no | 16 | 6.0 | 8.91 | 3.4 | | | |
| Day 9 | no | | | | | | | |
| Day 10 | no | 12 | 2.0 | 8.83 | 3.8 | | | |
| Day 11 | no | | | | | | | |
| Day 12 | no | 14 | 4.0 | 8.80 | 3.5 | 3.22 | 3–8 | 35 |
| Day 12 | yes | 13 | 6.0 | 8.75 | 3.5 | 2.22 | 1–4 | 85 |

TABLE 3

BATH 3

| | Ultrasonics Applied | Total Ti (ppm) | Filterable Ti (ppm) | pH | Total Alkali (points) | Coating Weight (g/sq m) | Crystal Size (microns) | Crystal Number |
|---|---|---|---|---|---|---|---|---|
| Day 1 | yes | 16 | 8 | 8.98 | 3.35 | 2.17 | 1–4 | 100 |
| Day 2 | no | | | | | | | |
| Day 3 | no | 16 | 5 | 8.91 | 3.50 | | | |
| Day 4 | no | | | | | | | |
| Day 5 | yes | 16 | 8 | 8.85 | 3.50 | | | |
| Day 8 | no | 16 | 6 | 8.79 | 3.40 | | | |
| Day 9 | no | | | | | | | |
| Day 10 | yes | 11 | 7 | 8.74 | 3.50 | | | |
| Day 11 | no | 12 | 6 | 8.73 | 3.50 | | | |
| Day 12 | no | 15 | 7 | 8.72 | 3.40 | 2.55 | 2–5 | 60 |
| Day 12 | yes | 12 | 6 | 8.80 | 3.40 | 2.34 | 1–4 | 75 |

TABLE 4

| BATH 4 | Ultrasonics Applied | Total Ti (ppm) | Filterable Ti (ppm) | pH | Total Alkali (points) | Coating Weight (g/sq m) | Crystal Size (microns) | Crystal Number |
|---|---|---|---|---|---|---|---|---|
| Day 1 | yes | 17 | 5 | 8.95 | 3.35 | 2.24 | 1–4 | 100 |
| Day 2 | yes | 17 | 7 | 8.89 | 3.30 | | | |
| Day 3 | yes | 17 | 11 | 8.84 | 3.40 | | | |
| Day 4 | yes | 16 | 9 | 8.81 | 3.40 | | | |
| Day 5 | yes | 16 | 10 | 8.78 | 3.50 | | | |
| Day 8 | yes | 16 | 8 | 8.73 | 3.40 | | | |
| Day 9 | yes | 16 | 8 | 8.73 | 3.40 | | | |
| Day 10 | yes | 14 | 7 | 8.68 | 3.90 | | | |
| Day 11 | yes | 14 | 11 | 8.69 | 3.90 | | | |
| Day 12 | no | 16 | 7 | 8.67 | 3.30 | 2.59 | 2–5 | 60 |
| Day 12 | yes | 15 | 8 | 8.70 | 3.40 | 2.30 | 1–4 | 90 |

TABLE 5

| BATH 5 | Ultrasonics Applied | Total Ti (ppm) | Filterable Ti (ppm) | pH | Total Alkali (points) | Coating Weight (g/sq m) | Crystal Size (microns) | Crystal Number |
|---|---|---|---|---|---|---|---|---|
| Day 1 | no | 16 | 16 | 8.97 | 3.1 | 2.33 | 2–6 | 60 |
| Day 2 | no | | | | | | | |
| Day 3 | no | 16 | 15 | 8.95 | 3.1 | | | |
| Day 4 | no | | | | | | | |
| Day 5 | no | 16 | 16 | 8.90 | 3.1 | | | |
| Day 8 | no | 16 | 16 | 8.83 | 3.2 | | | |
| Day 9 | no | | | | | | | |
| Day 10 | no | 14 | 12 | 8.76 | 3.5 | | | |
| Day 11 | no | | | | | | | |
| Day 12 | no | 16 | 16 | 8.75 | 3.1 | 3.98 | 10–40 | 2 |

FIGS. 1 through 6 are scanning electron photomicrographs, at a magnification of 1,000, of phosphate coated cold rolled steel panels. The phosphate coating was applied to cold rolled steel panels which had been activated with activating baths according to the experimental design. It is clear from an examination of the figures, and in particular, a comparison of FIGS. 5 and 1 with FIGS. 2 through 4 that the ultrasonic treatment of the activating bath substantially improves the phosphate coating which is formed on the metal substrate by the process.

As shown in Tables 1 through 5 and FIGS. 1 through 6, as the activating bath ages, its effectiveness for promoting the rapid formation of a high quality phosphate coating having a small crystal size and high crystal number decreases. Subjecting the activating bath to ultrasonic vibrations increases the usefulness of the activating bath for promoting a satisfactory phosphate conversion coating during the phosphating step of the process.

EXPERIMENT 2

A series of experiments was carried out to determine the effect of water hardness on the activating ability of the activating baths. The series of experiments disclosed that water hardness can have a deleterious effect on the ability of the activating bath to promote the formation of high quality, small crystal size phosphate coatings on metal substrates. The characterizations of the activating baths are shown in Table 6.

TABLE 6

| BATH | ACTIVATING BATH | CONCEN-TRATION | Mg2 + PPM | Ca2 + PPM | SONICATED | TOTAL Ti PPM |
|---|---|---|---|---|---|---|
| 6 | PARCOLENE ® Z | 1.2 g/L | 0 | 0 | NO | 17 |
| 7 | PARCOLENE ® Z | 1.2 g/L | 0 | 0 | YES | 16 |
| 8 | PARCOLENE ® Z | 1.2 g/L | 2 | 4 | NO | 18 |
| 9 | PARCOLENE ® Z | 1.2 g/L | 2 | 4 | YES | 16 |
| 10 | PARCOLENE ® Z | 1.2 g/L | 6 | 8 | NO | 15 |
| 11 | PARCOLENE ® Z | 1.2 g/L | 6 | 8 | YES | 14 |
| CONTROL | FIXODINE ® Z8 | 1.5 g/L | | | NO | 16 |

PARCOLEN ® Z contains the same titanium compound-phosphate compound reaction product as FIXODINE ® Z8 but does not contain condensed phosphate The test panels were coated according to the following procedure.

| STEP | MATERIAL | TEMPERATURE | TIME | APPLICATION METHOD |
|---|---|---|---|---|
| Clean | [1]PARCO ® CLEANER 150° C. 2 oz per gal. | 120° F. | 120 seconds | spray |
| Rinse | water | 100° F. | 60 seconds | spray |
| Activation | [2]PARCOLENE ® Z or FIXODINE ® Z8 | 90–100° F. | 30 seconds | immersion or spray |
| Conversion Coating | [3]BONDERITE ® 958 according to manuf. recommendations | 120–130° F. | 120 seconds | immersion |
| Rinse | | cold water | 60 seconds | spray |
| Rinse | deionized water | | 30 seconds | spray |
| Oven Dry | | 225° F. | 5 minutes | |

[1]PARCO ® CLEANER 1500C Alkaline cleaner (Product of Parker + Amchem)
[2]PARCOLENE ® Z Titanium compound-phosphate compound reaction product with added phosphates. Does not contain condensed phosphate. (Product of Parker + Amchem)
[3]FIXODINE ® Z8 Titanium compound-phosphate compound reaction product containing condensed phosphates. (Product of Parker + Amchem)
BONDERITE ® 958 A commercial acidic zinc-nickel-manganese phosphate conversion coating composition (Product of Parker + Amchem) used according to manufacturers' recommendations Table 6 shows the parameters of the activating baths. The content of titanium was adjusted to be approximately the same in all the baths. The amount of magnesium and calcium in the aqueous activating bath is shown in Table 6. In addition, application of ultrasonic energy to the activating bath is also shown in Table 6. The ultrasonic energy was applied to the baths in the absence of the metal substrate. Table 7 sets forth the coating weight, the crystal size and the coverage of the phosphate coating on the activated metal substrate provided by the process. The Coating Ratings 1 through 6 utilized in Table 7 and other tables in the specification are as follows: Ratings of 1–3 were given to panels which showed a continuous coating at 1,000 times magnification. A rating of 1 indicates small crystal size morphology, a rating of 3 indicates poor (large) crystal size morphology. Ratings of 4–6 were given if any discontinuities were observed in the coating at 1,000 times magnification. A rating of 4 indicates a coating with low coating weight and small crystal size, but with surface areas void of phosphate coating. A rating 6 indicates poor surface coverage and large crystal size.

TABLE 7

| | DAY 1 | DAY 2 | DAY 5 | DAY 6 | DAY 13 |
|---|---|---|---|---|---|
| BATH 6 | | | | | |
| COATING WEIGHT | 279 | 275 | 421 | 457 | |
| CRYSTAL SIZE | 2–10 | 2–8 | 5–15 | 5–21 | |
| COVERAGE RATING | 1 | 1 | 1 | 1 | |

TABLE 7-continued

| | DAY 1 | DAY 2 | DAY 5 | DAY 6 | DAY 13 |
|---|---|---|---|---|---|
| FILTERABLE Ti | 10 | 11 | 2 | 0 | |
| BATH 7 | | | | | |
| COATING WEIGHT | 231 | 221 | 212 | 197 | |
| CRYSTAL SIZE | 2–5 | 1–5 | 1–3 | 2–4 | |
| COVERAGE RATING | 1 | 1 | 1 | 1 | |
| FILTERABLE Ti | 10 | 12 | 12 | 12 | |
| BATH 8 | | | | | |
| COATING WEIGHT | 557 | 318 | 362 | 331 | |
| CRYSTAL SIZE | 5–40 | 20–60 | 20–60 | 9–65 | |
| COVERAGE RATING | 4 | 6 | 6 | 6 | |
| FILTERABLE Ti | 0 | 0 | 0 | 0 | |
| BATH 9 | | | | | |
| COATING WEIGHT | 566 | 464 | 438 | 443 | |
| CRYSTAL SIZE | 5–40 | 3–40 | 5–30 | 2–25 | |
| COVERAGE RATING | 4 | 5 | 5 | 4 | |
| FILTERABLE Ti | 0 | 0 | 0 | 0 | |
| BATH 10 | | | | | |
| COATING WEIGHT | 564 | 343 | 391 | 487 | 246 |
| CRYSTAL SIZE | 6–20 | 20–55 | 20–55 | 9–63 | 7–49 |
| COVERAGE RATING | 3 | 6 | 6 | 6 | 5 |
| FILTERALE Ti | 0 | 5 | 5 | 0 | |
| BATH 11 | | | | | |
| COATING WEIGHT | 593 | 488 | 451 | 487 | 405 |
| CRYSTAL SIZE | 5–40 | 6–40 | 7–35 | 7–29 | 4–25 |
| COVERAGE RATING | 3 | 5 | 5 | 5 | 3 |
| FILTERABLE Ti | 5 | 0 | 0 | 0 | |
| CONTROL | | | | | |
| COATING WEIGHT | 304 | 212 | 218 | 177 | 195 |
| CRYSTAL SIZE | 2–5 | 1–7 | 1–5 | 1–3 | 1–3 |
| COVERAGE RATING | 1 | 1 | 1 | 1 | 1 |

Coating weight - milligrams per square foot
Crystal size - microns

A study of the results of Baths 6 and 7, on days 1 and 2 as reported in Table 7 shows that a good coating with small crystal size and optimal coating weight was obtained with a fresh activating bath prepared from PARCOLENE® Z with deionized water.

Bath 7 is a sonicated bath with the same composition as Bath 6. As shown in Table 7, use of Bath 6 as an activating bath in the process provided a good coating when fresh, but did not provide suitable coatings on days 5 and 6. The crystal size substantially increased with a concurrent increase in coating weight. The coating weight, crystal size and coverage of the phosphate coating when prepared by the process which utilizes the sonicated activating Bath 7 was equivalent, even after aging, to that provided by the control, which was a fresh activating bath prepared every day and applied by spraying onto the cold rolled steel panel.

Figure 14:
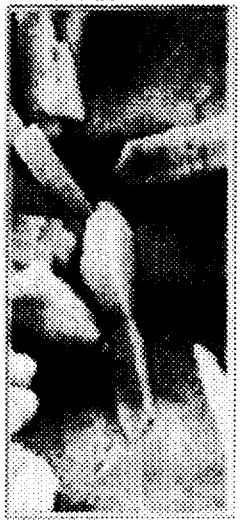
FIG. 14 is a scanning electron photomicrograph at 1,000 magnification of a phosphated cold rolled steel panel, prepared without contact with an activating bath in the process.
Figure 15A:
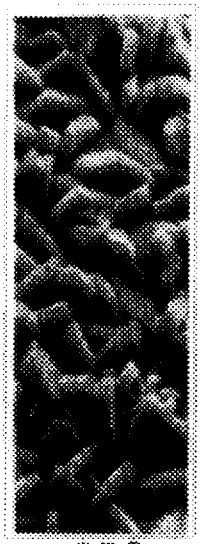
FIG. 15 (*a*), (*b*), (*c*), (*d*) and (*e*) are scanning electron photomicrographs at 1,000 magnification of the outer surface of phosphated panels of cold rolled steel (CRS), electrogalvanized steel (EG) and aluminum alloy 6061 (6061) prepared using activating Bath 11 under various conditions in the process.
Figure 15B:
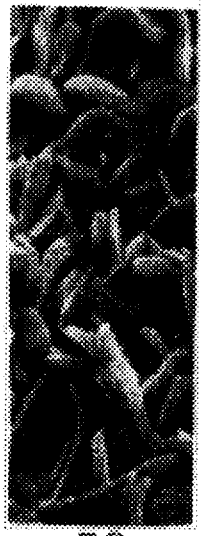
Figure 15C:
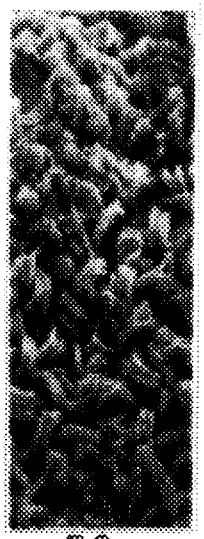
Figure 15D:
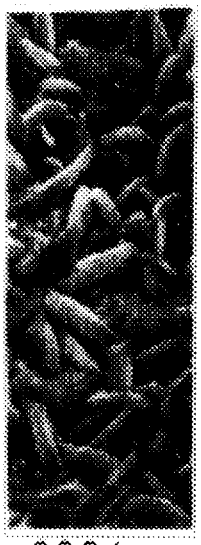
Figure 15E:
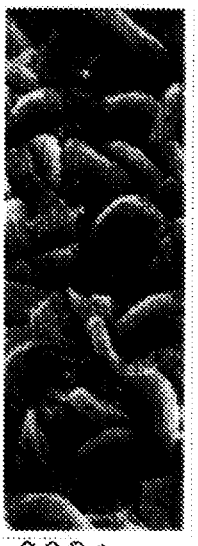
Figure 16A:
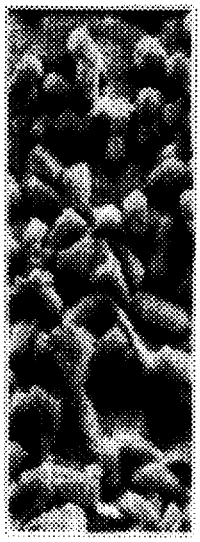
FIG. 16 (*a*), (*b*), (*c*), (*d*) and (*e*) are scanning electron photomicrographs at 1,000 magnification of the inner surface of phosphated panels of CRS, EG and 6061 prepared using activating Bath 11 under various conditions in the process.
Figure 16B:
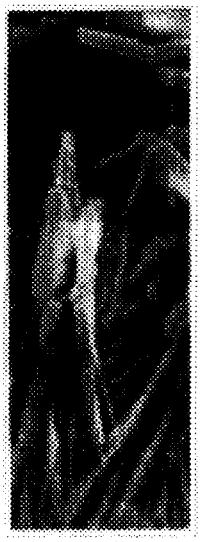
Figure 16C:
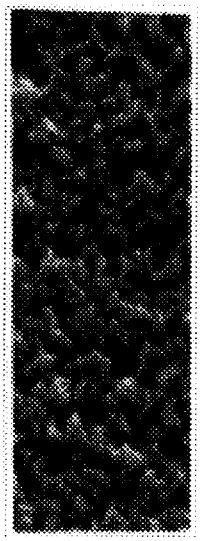
Figure 16D:
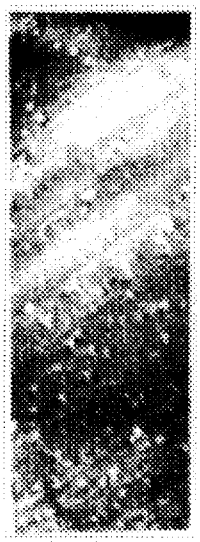
Figure 16E:
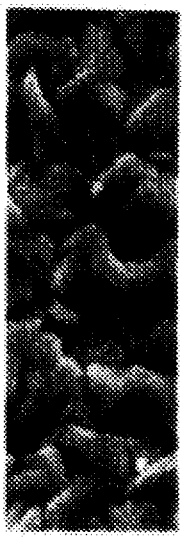
Figure 17A:
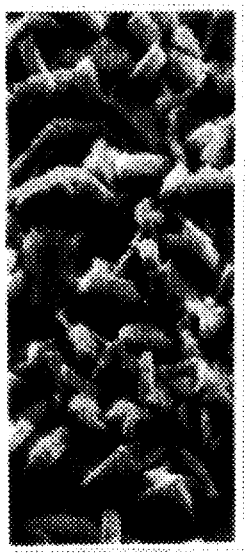
FIG. 17 (*a*), (*b*), (*c*), and (*d*) are scanning electron photomicrographs at 1,000 magnification of the outer surf ace of phosphated panels of CRS, EG and 6061 prepared using activating Bath 12 under various conditions in the process.
Figure 17B:
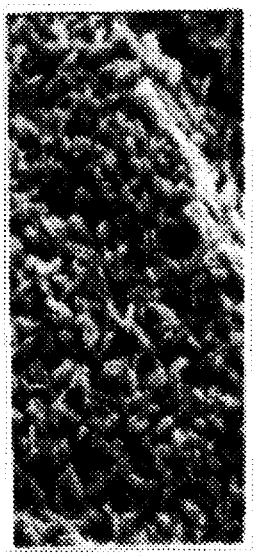
Figure 17C:
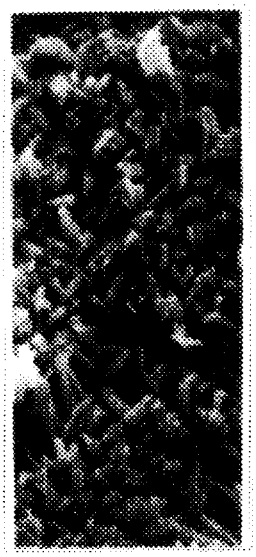
Figure 17D:
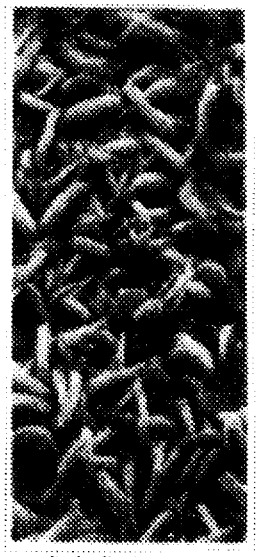
Figure 18A:
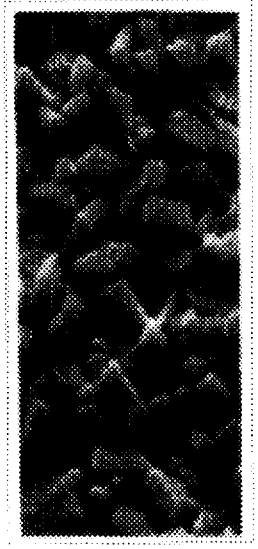
FIG. 18 (*a*), (*b*), (*c*), and (*d*) are scanning electron photomicrographs at 1,000 magnification of the inner surface of phosphated panels of CRS, EG and 6061 prepared using activating Bath 12 under various conditions in the process.
Figure 18B:
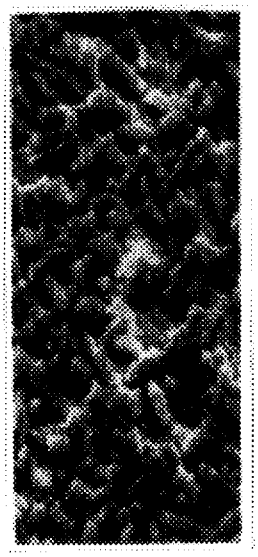
Figure 18C:
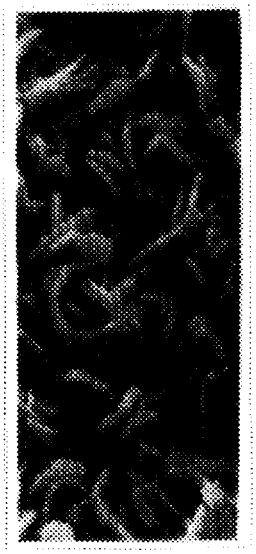
Figure 18D:
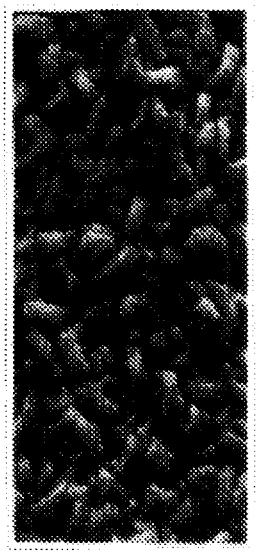
Figure 19A:
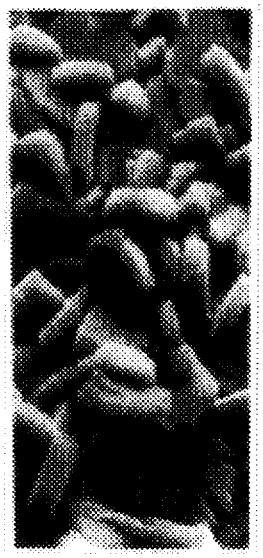
FIG. 19 (*a*), (*b*), (*c*), and (*d*) are scanning electron photomicrographs at 1,000 magnification of the outer surface of phosphated panels of CRS, EG and 6061 prepared using activating Bath 13 under various conditions in the process.
Figure 19B:
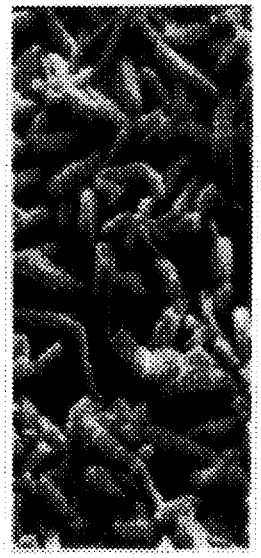
Figure 19C:
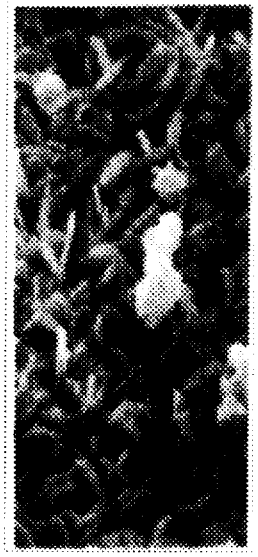
Figure 19D:
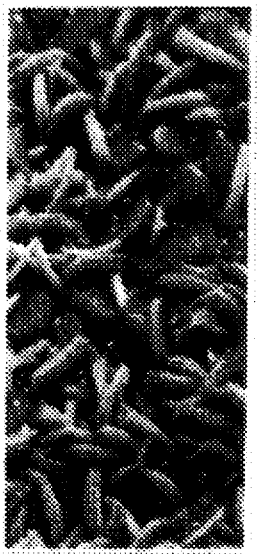
Figure 20A:
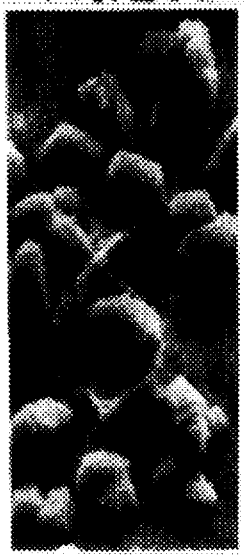
FIG. 20 (*a*), (*b*), (*c*), and (*d*) are scanning electron photomicrographs at 1,000 magnification of the inner surface of phosphated panels of CRS, EG and 6061 prepared using activating Bath 13 under various conditions in the process.
Figure 20B:
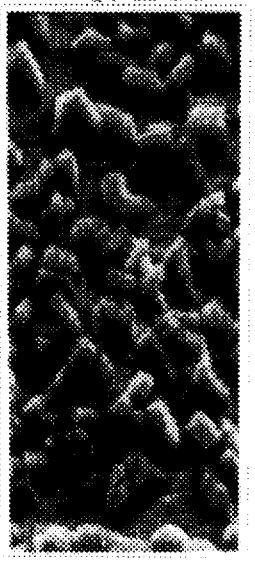
Figure 20C:
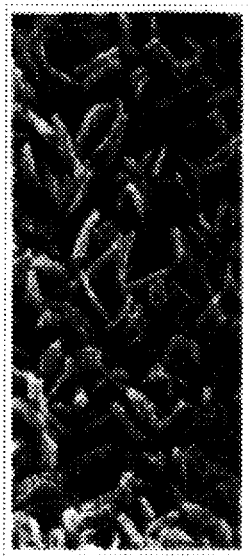
Figure 20D:
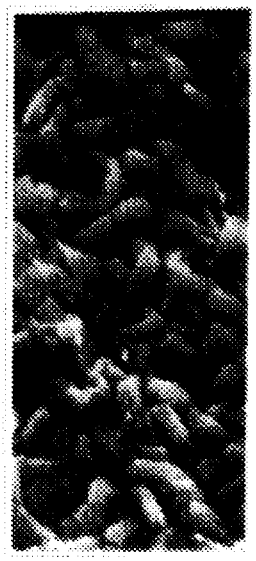

Table 7 also shows that the magnesium and calcium hardness in the water used to prepare the activating bath affected the ability of the bath to promote an optimal coating on the cold rolled steel panel. The loss of coating quality can be seen by the results reported as Baths 8, 9, 10 and 11. The ultrasonically treated Baths 9 and 11 promoted slightly better phosphate coatings than Baths 8 and 10 which were not ultrasonically treated. After one day aging the coatings were not satisfactory. Scanning electron photomicrographs at 1,000 times magnification of the phosphate coatings produced by use of activating Baths 6 through 11 and the Control Bath are shown in FIGS. 7 through 13 respectively. FIG. 14 is a scanning electron photomicrograph at 1,000 magnification of a phosphate coating produced on a non-activated cold rolled steel surface.

A study of FIGS. 7 through 14 clearly illustrates the effect of application of ultrasonic energy to the activating bath on the phosphate coating of the metal substrate produced by the process.

Table 7 also shows the characteristics of phosphate coatings produced by the process using activating Baths 10 and 11 after aging for 13 days; using the same procedure as for the previous examples (Bath 11, sonicated in the absence of the metal substrate). The phosphate coatings produced by the process using the activating Baths 10 and 11 aged for 13 days were not satisfactory.

An additional experiment was carried out using Bath 11 aged 13 days, but applying ultrasonic energy to the activating bath while it was contacting the metal panel being activated. Unexpectedly, the phosphated conversion coating produced on the activated panel was of excellent quality. A similar experiment was carried out using Bath 11 after aging for 150 days. Cold rolled steel, electrogalvanized steel and aluminum panels were processed. When ultrasonic energy was applied to Bath 11 after 150 days aging, when the bath was in contact with the metal panels, the phosphate coatings formed on the activated panels were excellent on all substrates. The phosphate coating was comparable to the phosphate obtained by the process by using the freshly prepared control activating bath.

In view of the excellent phosphate coatings which are obtained when the ultrasonic vibrations are applied to the aqueous activating bath in contact with the metal substrate to be activated, additional experiments were carried out to determine the effectiveness of the treatment.

It is not completely clear whether the improvement in the phosphate coating obtained by the process, when ultrasonic energy is applied to the activating bath in the presence of the metal substrate, is due solely to an optimization of the size of the particles of the activating bath during sonication, or whether an element of the improvement is due to an interaction between the ultrasonic vibrations and the metal substrate.

EXPERIMENT 3

In many applications where a phosphate coating is desired, the parts to be coated are irregularly shaped with recessed or boxed areas. These recessed areas are more difficult to coat with a high quality phosphate coating. A series of experiments were carried out to determine the effect of ultrasonic energy application during the phosphate coating process, when the surface of the substrate is not directly exposed to the ultrasonic vibrations. Four inch by six inch metal panels were inserted into a plastic frame to form a box in which the internal surfaces of the box were not directly exposed to the ultrasonic vibrations. The two panels inserted in the plastic frame were separated by [illegible]th of an inch between the panels. The top and bottom of the box contained holes which allowed the activating bath to fill the box while hindering the circulation of the activating solution in the box. The coatings formed on the panels were rated according to the method set forth (1–6).

Both the panel surfaces which formed the outside of the box and the panel surfaces which formed the inside of the box were examined for phosphate coating characteristics and rated. The 150 day old PARCOLENE® Z Bath 11 was included in the study since 150 day old Bath 11, when ultrasonic energy was applied during activation in the contact zone, provided a metal substrate with an excellent phosphate coating. In addition, activating baths with reduced amounts of titanium were prepared and tested as the activating bath in the process.

The compositions of the baths are set forth in Table 8.

TABLE 8

| BATH | CONDTIONER | CONCENTRATION | $Mg^{2+}$ PPM | $Ca^{2+}$ PPM | SONICATED | TOTAL Ti PPM |
|---|---|---|---|---|---|---|
| 11 | PARCOLENE ® Z | 1.2 g/L | 6 | 8 | YES | 14 |
| 12 | PARCOLENE ® Z | 0.37 g/L | 6 | 8 | YES | 5 |
| 13 | PARCOLENE ® Z | 0.37 g/L | 11 | 22 | YES | 5 |
| CONTROL | FIXODINE ® Z8 | 1.5 g/L | 11 | 22 | NO | 16 |

FIGS. 15 and 16 are scanning electron photomicrographs, at a 1,000 times magnification, of the phosphated side of the panel which was the the outer surface of the box and the side of the phosphated panel which formed the inner surface of the box which were treated by aqueous activiting Bath 11. The various treatments are noted as a, b, c, d, and e in FIG. 15 and FIG. 16. FIGS. 15 and 16 clearly show the improvement in the phosphate coating on both the inner and outer surfaces when ultrasonic vibrations are applied to the activating bath when it is in contact with the metal substrate in the process of the invention. Table 9 presents the crystal size and coverage of the phosphate coating when applied to cold rolled steel, galvanized steel and aluminum alloy 6061 by the process of the invention when ultrasonic energy is applied to the activating baths, as set forth in Table 8, when the baths are in contact with the box formed from the metal panels.

TABLE 9

| | | CRS | | EG | | 6061 | |
|---|---|---|---|---|---|---|---|
| | SONICATE | outside | inside | outside | inside | outside | inside |
| BATH 11 | | | | | | | |
| CRYSTAL SIZE | NO | | | 5–12 | 10–40 | 4–12 | 20–30 |
| COVERAGE RATING | NO | | | 2 | 3 | 4 | 5 |
| CRYSTAL SIZE | YES | 3–15 | 3–8 | 3–7 | 3–6 | 5–20 | 5–12 |
| COVERAGE RATING | YES | 2 | 4 | 1 | 1 | 2 | 4 |
| BATH 12 | | | | | | | |
| CRYSTAL SIZE | NO | 4–15 | 3–12 | | | | |
| COVERAGE RATING | NO | 2 | 4 | | | | |
| CRYSTAL SIZE | YES | 2–7 | 3–7 | 3–7 | 3–7 | 4–10 | 3–6 |
| COVERAGE RATING | YES | 1 | 4 | 1 | 2 | I | 2 |
| BATH 13 | | | | | | | |
| CRYSTAL SIZE | NO | 5–20 | 4–15 | | | | |
| COVERAGE RATING | NO | 3 | 5 | | | | |
| CRYSTAL SIZE | YES | 2–12 | 4–6 | 2–8 | 2–8 | 3–10 | 4–10 |
| COVERAGE RATING | YES | 2 | 4 | 1 | 1 | 1 | 2 |
| CONTROL | | | | | | | |
| CRYSTAL SIZE | NO | 2–6 | 1–3 | 2–8 | 2–5 | 3–8 | 2–7 |
| COVERAGE RATING | 1 | 1 | 1 | 1 | 1 | 1 | 1 |

Crystal size-mirons

The phosphate coatings formed by the process are improved. The surfaces of the metal panels which faced the interior of the box also showed improvement in the phosphate conversion coating. In all cases in which ultrasonics were applied, coating coverage and crystal size on an electrogalvanized steel on both the inner and outer panel surfaces was excellent. The effect of the 150 day old activating Bath 11 without application of ultrasonic vibrations (stirred) is shown for comparison. The inner and outer panel surfaces of aluminum phosphated after treatment with activating Bath 11 showed a significant improvement due to application of ultrasonic vibration when in contact with the metal substrate. The inner surface is almost completely covered with a phosphate coating with application of ultrasonic energy while it is almost completely bare when treated with the activating bath without application of ultrasonic energy. The outer surfaces of the CRS were completely phosphate coated when activated by the 150 day old Bath 11 with application of ultrasonic energy. The inner surfaces of the CRS showed incomplete coating but the coating is significantly better than the coating formed when processed with Bath 10 after only 1 day aging (FIG. 11 (*b*)).

Baths 12 and 13 which contained a reduced amount of the activating composition (low titanium level) also showed improved phosphated coating when ultrasonic energy was applied to the activating bath when the bath was in contact with the metal substrates.

FIGS. 17 and 18 are scanning electron photomicrographs at 1,000 magnification of the outer surface and the inner surface of the metal panels prepared by the process of the invention utilizing Bath 12 with the reduced content of activating composition. A comparison of FIG. 17 and 18 (*a*) and (*b*) clearly shows the improvement when ultrasonic energy is applied to the activating bath when the bath is in contact with the metal substrate. The inner and outer surfaces of the panels show improved phosphate coating. FIGS. 17 and 18 (*c*) and (*d*) show the effect of application of ultrasonic energy to the activiting bath on the coating of electrogalvanized steel and aluminum alloy 6061.

FIGS. 19 and 20 are scanning electron photomicrographs at 1,000 magnification of the outer and inner surfaces of metal panels treated with activating Bath 13. It is clear from a comparison of FIG. 19 and FIG. 20 (*a*) and (*b*) that application of ultrasonic energy to the bath while the metal substrate is immersed in the bath substantially improves the crystal size and coverage obtained in the phosphate coating formed by the process of the invention.

Figure 21A:
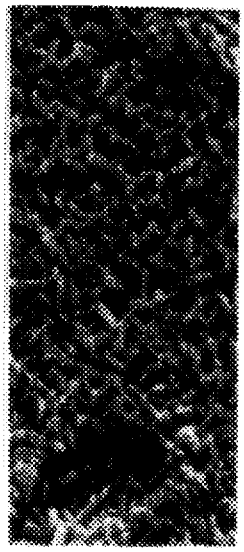
FIG. 21 (*a*), (*b*) and (*c*) are scanning electron photomicrographs at 1,000 magnification of the outer phosphated surface of metal panels prepared using a freshly prepared control bath in the process.
Figure 21B:
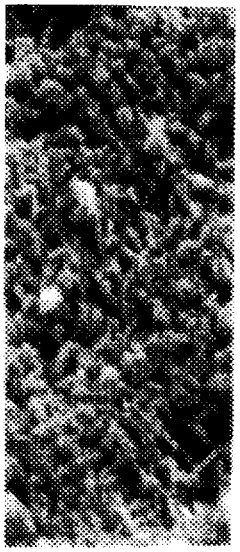
Figure 21C:
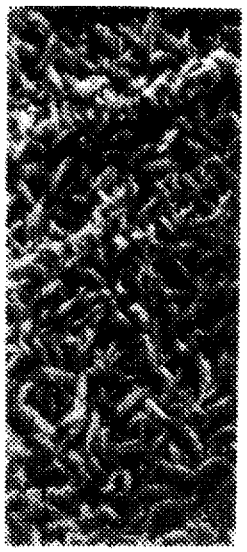
Figure 22A:
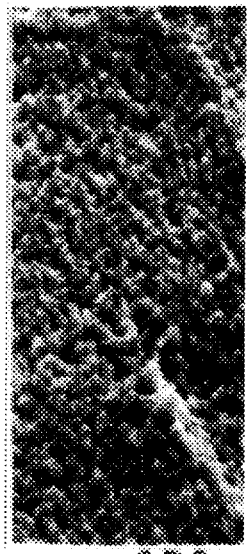
FIG. 22 (*a*), (*b*) and (*c*) are scanning electron photomicrographs at 1,000 magnification of the inner phosphated surface of metal panels prepared using a freshly prepared control bath in the process.
Figure 22B:
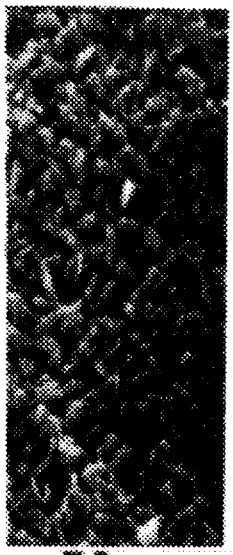
Figure 22C:
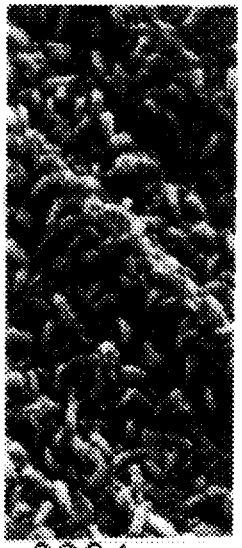

FIGS. 21 and 22 (*a*), (*b*) and (*c*) are scanning electron photomicrographs at 1,000 magnification of the outer and the inner surfaces of panels formed from cold rolled steel, galvanized steel and aluminum alloy 6061 using a freshly prepared control bath for activation.

FIGS. 15, 16, 17, 18, 19 and 20 illustrate that the application of ultrasonic energy to the aqueous activating bath in the presence of the metal substrate to be activated comprises a significant improvement in the activation of both the exposed and recessed surfaces. The figures also indicate that the concentration of the activating composition in the activating bath can be reduced if ultrasonic energy is applied to the activating bath while the metal substrate is in contact with the activating bath.

EXPERIMENT 4

Tests were run to determine the effect of application of ultrasonic energy to FIXODINE® Z8 aqueous activating baths. Treatment Baths 14, 15, 16, 17, 18 and 19 were prepared. Baths 14, 15, 16, and 17 utilized various concentrations of FIXODINE® Z8 and were prepared utilizing tap water. Baths 18 and 19 were prepared with PARCOLENE® Z at a low concentration utilizing tap water.

The compositions of the baths and the treatments are set out in Table 10.

TABLE 10

| BATH | CONDITIONER | CONCEN-TRATION | WATER | SONI-CATED | TOTAL Ti PPM |
|---|---|---|---|---|---|
| 14 | FIXODINE ® Z8 | 1.5 g/L | Tap | NO | 16 |
| 15 | FIXODINE ® Z8 | 1.5 g/L | Tap | YES | 17 |
| 16 | FIXODINE ® Z8 | 0.5 g/L | Tap | NO | 5 |
| 17 | FIXODINE ® Z8 | 0.5 g/L | Tap | YES | 4 |
| 18 | PARCOLENE ® Z | 0.4 g/L | Tap | NO | 6 |
| 19 | PARCOLENE ® Z | 0.4 g/L | Tap | YES | 6 |
| CON-TROL | FIXODINE ® Z8 | 1.5 g/L | Tap | NO | 16 |

All cold rolled steel panels treated with the fresh FIXODINE® Baths 14 through 17 and the control bath produced good phosphate coatings with or without application of ultrasonic power to the activating baths. The PARCOLENE® Z activating bath did not provide a good coating when the fresh solution was stirred. When ultrasonic energy was applied to Bath 19 while in contact with the metal substrate to activate the substrate, the phosphate coating produced by the process was satisfactory. The characteristics of the phosphate coatings are shown in Table 11.

TABLE 11

| | BATH 14 | BATH 15 | BATH 16 | BATH 17 | BATH 18 | CON-TROL |
|---|---|---|---|---|---|---|
| SONICATE | NO | YES | NO | YES | NO | NO |
| COATING WEIGHT | 219 | 195 | 312 | 276 | 369 | 207 |
| CRYSTAL SIZE | 1–4 | 1–5 | 3–12 | 2–10 | 20–40 | 1–5 |
| COVERAGE RATING | 1 | 1 | 1 | 1 | 6 | 1 |

Coating weight - milligrams/Ft$^2$
Crystal size - microns

The activating Baths 14–19 were then aged for 90 days and used to treat cold rolled steel, electrogalvanized steel, and aluminum alloy 6061. In all cases when ultrasonic vibration energy was applied to the activating baths (Bath 14–19) while the baths were in contact with the metal substrate, the phosphated coatings were good. The results of the tests are shown in Table 12.

TABLE 12

| | Sonica-tion | Filter-able Ti | CRS | EG | 6061 |
|---|---|---|---|---|---|
| BATH 14 | none | 9 | | | |
| Coating Weight | | | 354 | 411 | 315 |
| Crystal Size | | | 4–10 | 3–11 | 2 –13 |
| Coverage Rating | | | 2 | 1 | 4 |
| BATH 15 | yes | 4 | | | |
| Coating Weight | on | | 222 | 312 | 282 |
| | off | | 246 | 321 | 279 |
| Crystal Size | on | | 2–4 | 2–7 | 2–12 |
| | off | | 2–4 | 2–6 | 2–14 |
| Coverage Rating | on | | 1 | 1 | 1 |
| | off | | 1 | 1 | 1 |
| BATH 16 | none | 0 | | | |
| Coating weight | | | 519 | 531 | 252 |
| Crystal size | | | 15–40 | 3–8 | 10–25 |
| Coverage Rating | | | 6 | 1 | 6 |
| BATH 17 | yes | 0 | | | |
| Coating Weight | on | | 243 | 378 | 285 |
| | off | | 345 | 423 | 309 |
| Crystal Size | on | | 1–4 | 3–8 | 2–13 |
| | off | | 3–10 | 3–12 | 4–20 |
| Coverage Rating | on | | 1 | 1 | 4 |
| | off | | 2 | 2 | 4 |
| BATH 18 | none | 0 | | | |
| Coating Weight | | | 543 | 519 | 294 |
| Crystal Size | | | 20–70 | 7–20 | 10–25 |
| Coverage Rating | | | 6 | 3 | 6 |
| BATH 19 | yes | 0 | | | |
| Coating Weight | on | | 381 | 411 | 345 |
| | off | | 588 | 456 | 294 |
| Crystal Size | on | | 3–8 | 2–8 | 3–20 |
| | off | | 10–50 | 3–10 | 15–30 |
| Coverage Rating | on | | 2 | 1 | 5 |
| | off | | 6 | 1 | 6 |
| Control | none | | | | |
| Coating Weight | | | 222 | 297 | 255 |
| Crystal Size | | | 2–4 | 2–7 | 2–14 |
| Coverage Rating | | | 1 | 1 | 1 |

Coating weight-milligrams/Ft$^2$
Crystal size-microns

Table 12 presents the characteristics of the phosphate coatings formed on the metal substrates according to the process of the invention utilizing the activating Baths 14, 15, 16, 17, 18 and 19. The results shown in Table 12 were obtained utilizing the baths which had been aged for 90 days. It is clear that the 90 day old FIXODINE® Z8 bath (Bath 14) does not provide an acceptable phosphate coating on the surface of cold rolled steel, electrogalvanized steel or aluminum alloy 6061. However, application of ultrasonic energy to the aged bath (Bath 15), when in contact with the metal substrate produces excellent phosphate coatings on cold rolled steel, electrogalvanized steel and aluminum treated by the process of the invention.

Figure 23A:
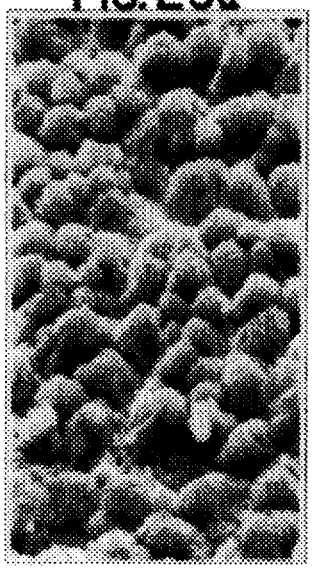
FIG. 23 (*a*), (*b*) and (*c*) are scanning electron photomicrographs at 1,000 magnification of phosphated metal panels (a) CRS, (b) EG and (c) 6061 prepared using stirred Bath 14 (for comparison) in the process.
Figure 23B:
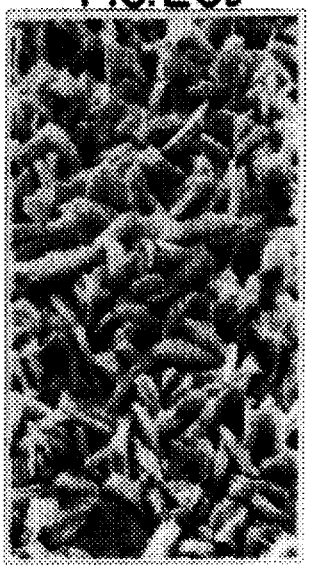
Figure 23C:
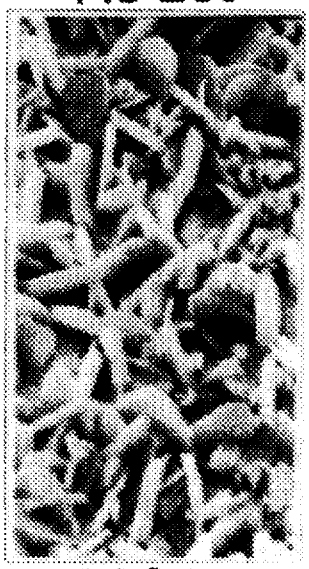
Figure 24A:
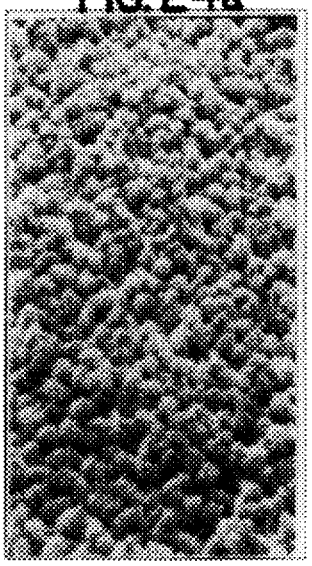
FIG. 24 (*a*), (*b*) and (*c*) are scanning electron photomicrographs at 1,000 magnification of phosphated metal panels (a) CRS, (b) EG and (c) 6061 prepared by the process by applying ultrasonic energy to Bath 15 while the metal panels were immersed in the bath.
Figure 24B:
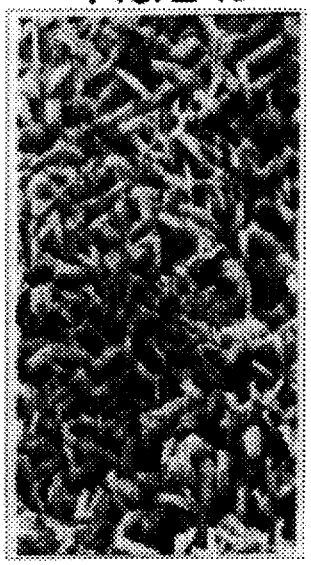
Figure 24C:
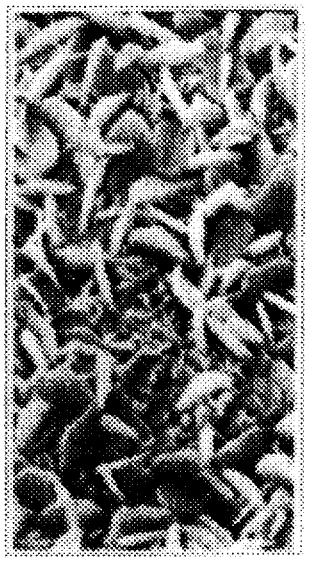

FIGS. 23 (*a*), (*b*) and (*c*) are scanning electron photomicrographs at 1,000 magnification of panels phosphated utilizing the process of the invention and utilizing Bath 14 as the activating bath. FIG. 24 is a scanning electron photomicrograph at 1,000 magnification of the crystal structure of the phosphate coating formed by the process of the invention on various metal substrates when ultrasonic energy is applied to Bath 15 while Bath 15 is in contact with the metal substrate. FIG. 24 (*a*), (*b*) and (*c*) shows that cold rolled steel, electrogalvanized steel and aluminum alloy 6061 are provided with excellent phosphate coatings by the process of the invention.

Figure 25A:
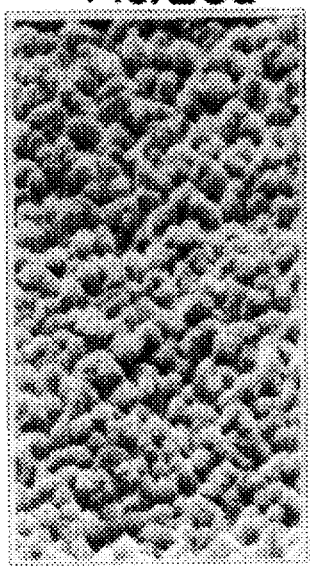
FIG. 25 (*a*), (*b*) and (*c*) are scanning electron photomicrographs at 1,000 magnification of phosphated metal panels (a) CRS, (b) EG and (c) 6061 prepared using Bath 15 five minutes after stopping application of ultrasonic energy to the bath in the process.
Figure 25B:
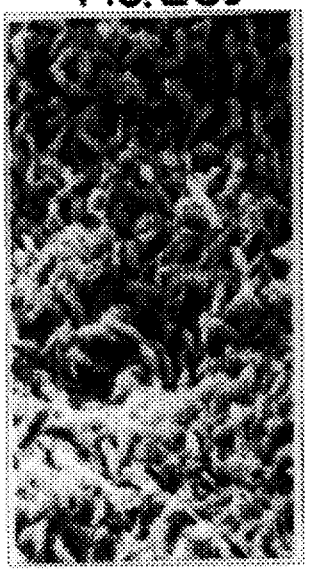
Figure 25C:
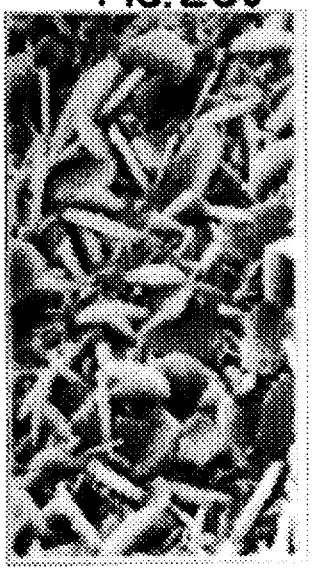

FIG. 25 is a scanning electron photomicrograph at 1,000 magnification of the phosphate coating provided on panels which were contacted with activating bath 15 five minutes after application of ultrasonic energy to the activating bath was discontinued. FIG. 25 shows that the phosphate coating is acceptable even when the metal substrate is contacted with activating Bath 15 five minutes after the application of ultrasonic energy to the bath has been stopped.

Baths 14 and 15 produced coatings identical to the control bath after aging for one day. After aging for 90 days, the difference in the phosphate coating produced by the process due to application of ultrasonic energy to the activating bath can be clearly seen. FIGS. 23 through 25 show the effects of application of ultrasonic energy to the activating bath on the phosphate coating produced by the process of the invention. The coatings formed after the ultrasonic energy application had been discontinued 5 minutes before the panels were entered in the solution were satisfactory (see FIG. 25).

Baths 16 and 17 contained a concentration of the activating composition only ⅓ of the concentration in Baths 11 and 12. Baths 16 and 17 showed a reduced activating ability after aging only one day. Bath 16, with stirring only, and contacted with the metal panel, produced a coating with larger crystal size and higher coating weights than Bath 14.

Figure 26A:
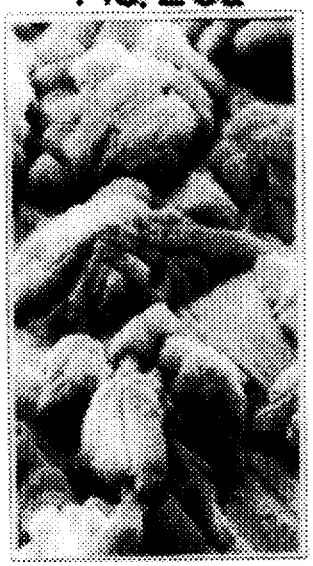
FIG. 26 (*a*), (*b*) and (*c*) are scanning electron photomicrographs at 1,000 magnification of phosphated metal panels prepared using stirred Bath 16 in the process (for comparison).
Figure 26B:
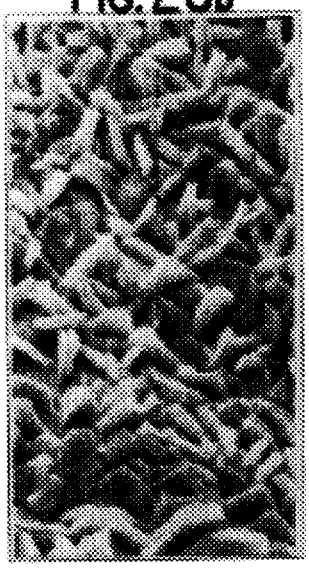
Figure 26C:
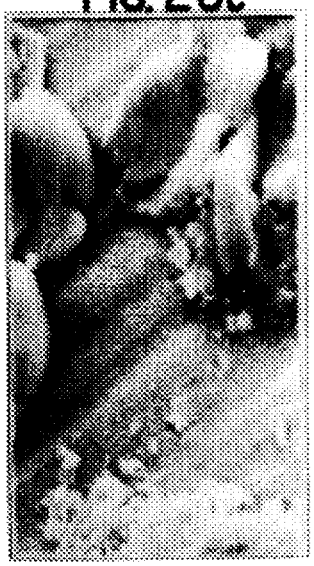
Figure 27A:
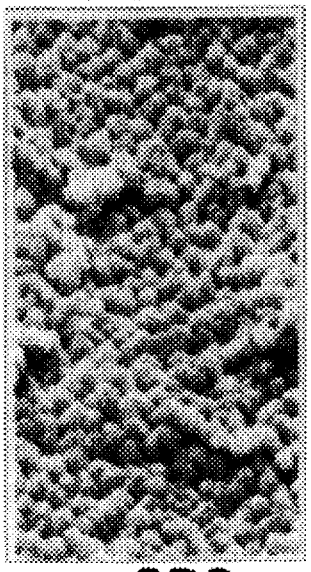
FIG. 27 (*a*), (*b*) and (*c*) are scanning electron photomicrographs at 1,000 magnification of phosphated metal panels prepared by the process by applying ultrasonic energy to Bath 17 while the metal panels were immersed in the bath.
Figure 27B:
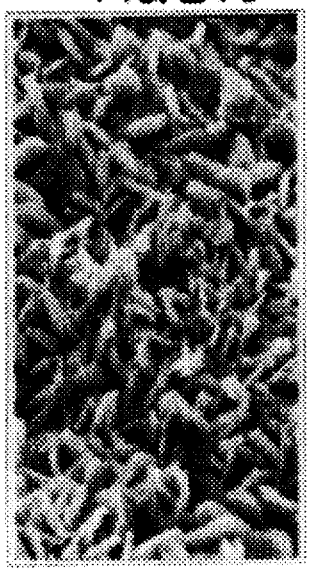
Figure 27C:
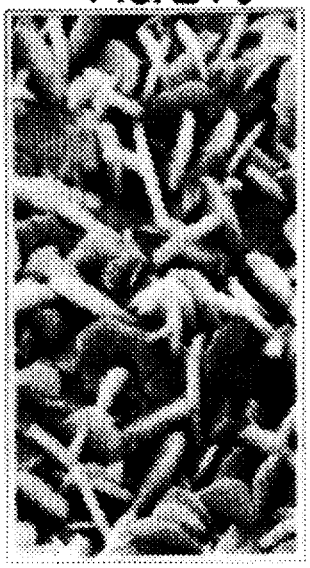
Figure 28A:
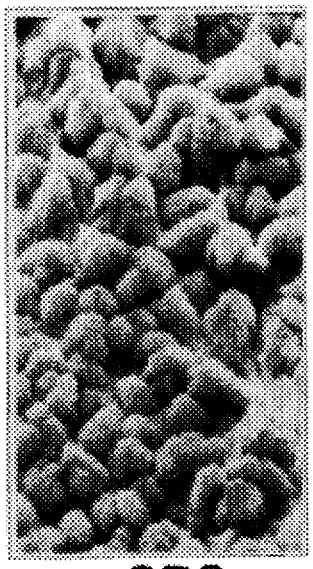
FIG. 28 (*a*), (*b*) and (*c*) are scanning electron photomicrographs at 1,000 magnification of phosphated metal panels prepared by the process wherein the metal panels are immersed in Bath 17 five minutes after the ultrasonic vibrations were discontinued.
Figure 28B:
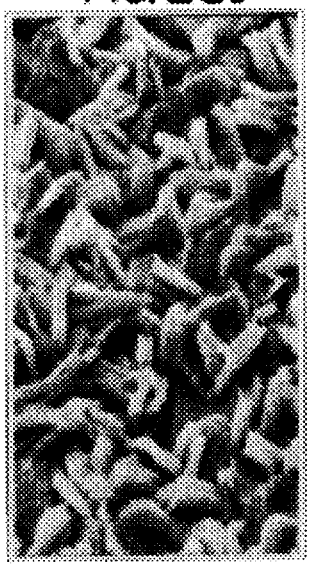
Figure 28C:
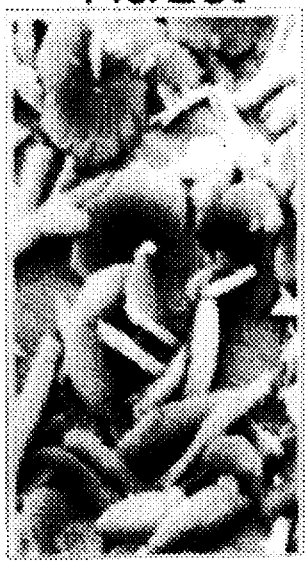
Figure 29A:
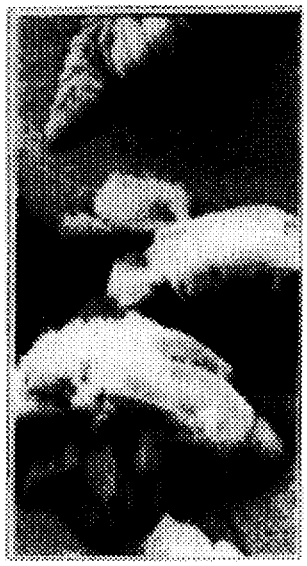
FIG. 29 (*a*), (*b*) and (*c*) are scanning electron photomicrographs at 1,000 magnification of phosphated metal panels prepared using stirred Bath 18 in the process (for comparison).
Figure 29B:
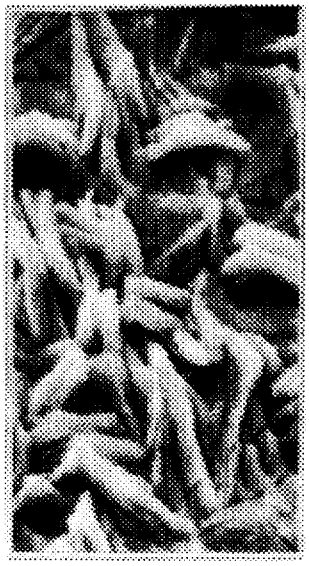
Figure 29C:
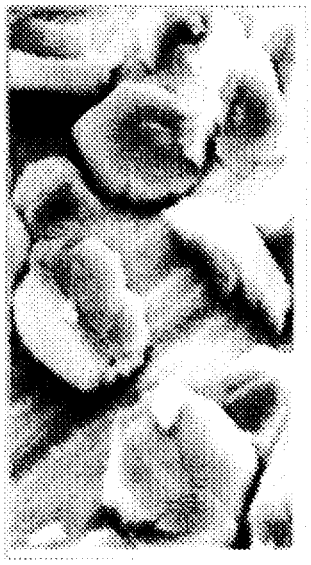
Figure 30A:
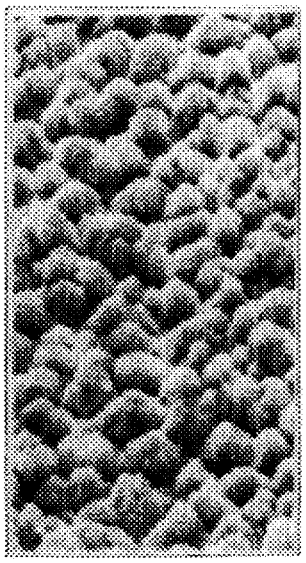
FIG. 30 (*a*), (*b*) and (*c*) are scanning electron photomicrographs at 1,000 magnification of phosphated metal panels prepared by the process by immersing the panels in Bath 19 while ultrasonic energy was applied to Bath 19.
Figure 30B:
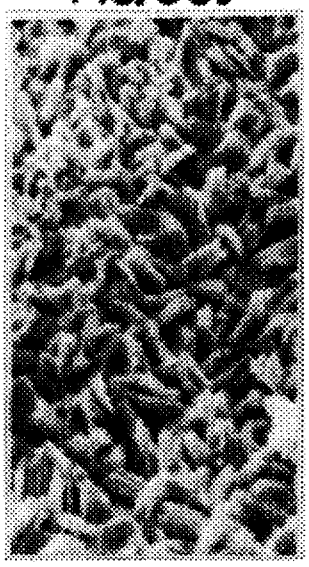
Figure 30C:
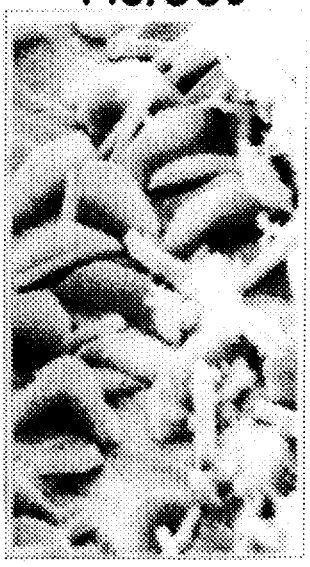
Figure 31A:
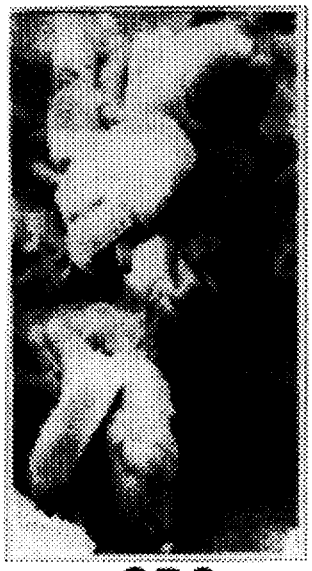
FIG. 31 (*a*), (*b*) and (*c*) are scanning electron photomicrographs at 1,000 magnification of phosphated metal panels prepared by the process by immersing the panels in Bath 19 five minutes after the application of ultrasonic energy to the bath was stopped.
Figure 31B:
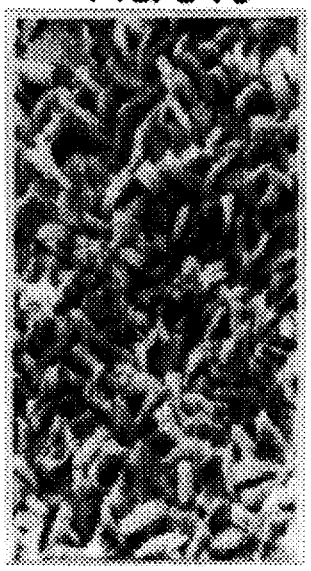
Figure 31C:
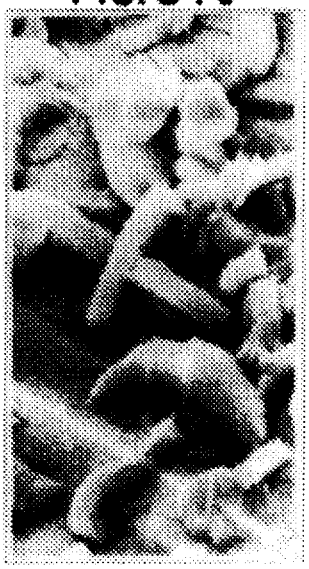

FIGS. 26, 27 and 28 show the coatings formed after aging the baths for 90 days. Panels treated with activating Bath 16 produced poor coatings when phosphated; however Bath 17 produced excellent phosphate coatings on cold rolled steel, electrogalvanized steel and aluminum alloy 6061 when ultrasonic energy was applied to the Bath 17 while activating Bath 17 was in contact with the metal substrate or within 5 minutes of stopping the application of the ultrasonic energy to the bath.

Figure 32A:
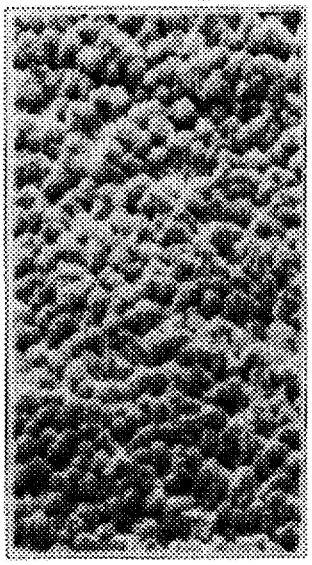
FIG. 32 (*a*), (*b*), and (*c*) are scanning electron photomicrographs of phosphated metal panels prepared by the process using a freshly prepared control bath.
Figure 32B:
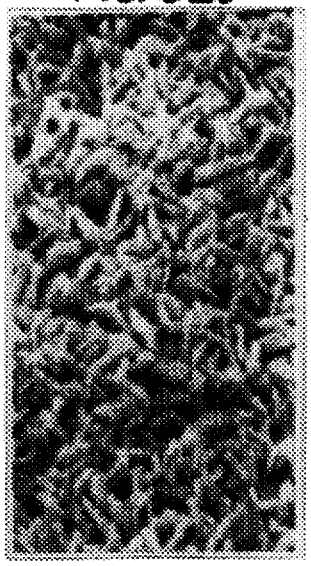
Figure 32C:
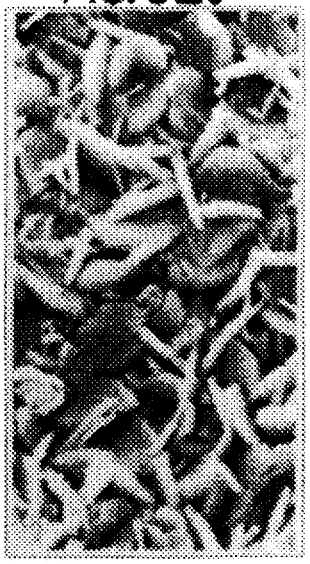

Phosphate coatings produced on cold rolled steel, aluminum alloy 6061 and electrogalvanized steel by the process using activating Bath 17 with application of ultrasonic energy to the activating bath when in contact with the metal panel were identical with phosphate coatings prepared by the process utilizing the control bath (FIG. 32). The aluminum panel appeared to have several small voids in the coating where the metal surface could be seen in the scanning electron photomicrograph. After the application of ultrasonic energy to activating Bath 17 had been discontinued for 5 minutes, a slight loss of activating ability can be noted. The phosphated coatings produced by the process using activating Bath 17 with application of ultrasonic energy to the bath when in contact with the metal substrate were comparable to coatings produced from the fresh control bath containing 3 times the concentration of the FIXODINE® Z8 activating composition.

The PARCOLENE® Z bath which does not contain condensed phosphates, (Bath 18), produces poor coatings when the activating bath is prepared with tap water containing calcium and magnesium ion. After aging for only one day, the bath produced coatings similar to panels processed without contact with an aqueous activating bath. Activating Bath 19, to which ultrasonic energy was applied while in contact with the metal substrate, when phosphated, provided a coating comparable to the FIXODINE® Z8 Bath 14 on cold rolled steel and electrogalvanized steel. The coating produced by using activating Bath 19 on aluminum in the process was slightly more porous than that produced by using Bath 14. After the ultrasonic energy application had been discontinued for 5 minutes, the coatings on cold rolled steel and aluminum were similar to coatings produced by activating Bath 18, while the coating on electrogalvanized steel was excellent. FIGS. 23 through 31 and FIG. 32 (control bath) illustrate the improved coatings provided by the process of the invention.

The experiments and the figures clearly illustrate that application of ultrasonic energy to an aqueous activating bath in a phosphate coating process improves the coating weight and crystal morphology of the phosphate coating. The application of ultrasonic energy to the activating bath extends the useful life of the bath. Extension of the useful life of the activating bath provides a process in which the activating bath is discarded at more extended intervals and therefore reduces the effect of the process on the environment.

The examples and the figures clearly show that phosphate coatings can be improved by the process of the present invention if ultrasonic energy is applied to the aqueous activating composition (activating bath) when not in contact with a metal substrate or when the aqueous activating bath is in contact with the metal substrate which is subsequently to be coated with a phosphate conversion coating.

The process of the present invention with the improvement of applying ultrasonic energy to the aqueous activating bath in the process, as shown by the examples and figures, improves the phosphate coating produced by the process and extends the life of the aqueous activating composition. Aged baths retain their activating ability over extended periods. In addition, the activating bath can contain lower concentrations of the activating composition and still be useful in activating the metal substrate in a phosphate coating processes. The lower concentrations of the activating composition, which can be used in the activating bath along with the longer useful life of the activating bath, provides a less expensive and more environmentally friendly process.

We claim:

1. An improved process for forming a phosphate conversion coating on a metal substrate, wherein the surface of the metal substrate is cleaned, activated by contact with an aqueous activating composition comprising a reaction product of a titanium compound and a phosphorus compound and coated by a conversion coating process, the improvement which comprises: applying ultrasonic vibration energy to the aqueous activating composition.

2. The process of claim 1 wherein the ultrasonic vibration energy is applied to the aqueous activating composition in the presence of the metal substrate to be activated.

3. The process of claim 1 wherein the ultrasonic vibration energy is applied to the aqueous activating composition in the absence of the metal substrate.

4. The process of claim 1 wherein the surface of the metal substrate comprises a metal selected for the group consisting of iron, zinc, zinc alloys, aluminum and aluminum alloys.

5. The process of claim 1 which comprises: (1) cleaning the surface of the metal substrate with an alkaline cleaning composition; (2) contacting the clean surface of the metal substrate with the aqueous activating composition to which ultrasonic vibration energy is applied and (3) forming a phosphate conversion coating on the metal surface which has been contacted with the aqueous activating composition.

6. A process of claim 5 wherein the aqueous activating composition comprises from about 2 to about 30 parts per million of titanium.

7. A process of claim 1 wherein the aqueous activating composition comprises from about 2 to about 30 parts per million of titanium.

8. A process of claim 1 wherein the aqueous activating composition contains water, a reaction product of a titanium compound with a phosphorus compound, and a condensed phosphate.

9. A process of claim 1 wherein titanium and phosphorus are provided by a composition comprising the reaction product of a titanium compound with a phosphate compound.

10. A process of claim 9 wherein the metal substrate is contacted with the aqueous activating composition at a temperature of from ambient to about 150° F.

11. A process of claim 3 wherein the metal substrate is contacted with the aqueous activating composition in an activating zone and the ultrasonic vibration energy is applied to the aqueous activating composition in an ultrasonic zone outside of the activating zone.

12. A process of claim 1 wherein an average age of the aqueous activating composition is greater than five days.

* * * * *